US007097961B2

(12) United States Patent
Louwet et al.

(10) Patent No.: US 7,097,961 B2
(45) Date of Patent: Aug. 29, 2006

(54) STABILIZERS FOR USE IN SUBSTANTIALLY LIGHT-INSENSITIVE THERMOGRAPHIC RECORDING MATERIALS

(75) Inventors: Frank Louwet, Diepenbeek (BE); Johan Loccufier, Zwijnaarde (BE)

(73) Assignee: Agfa Gevaert, Mortsel (BE)

( * ) Notice: Subject to any disclaimer, the term of this patent is extended or adjusted under 35 U.S.C. 154(b) by 0 days.

(21) Appl. No.: 11/127,645

(22) Filed: May 12, 2005

(65) Prior Publication Data

US 2005/0255415 A1 Nov. 17, 2005

Related U.S. Application Data

(60) Provisional application No. 60/576,438, filed on Jun. 3, 2004.

(30) Foreign Application Priority Data

May 17, 2004 (EP) ..... 04102147

(51) Int. Cl.
*G03C 1/494* (2006.01)
*G03C 1/34* (2006.01)

(52) U.S. Cl. ..... 430/611; 430/618; 430/620; 430/964; 430/965

(58) Field of Classification Search ..... 430/611, 430/618, 620, 964, 965
See application file for complete search history.

(56) References Cited

U.S. PATENT DOCUMENTS

| | | | |
|---|---|---|---|
| 3,074,809 | A | 1/1963 | Owen |
| 3,446,648 | A | 5/1969 | Workman |
| 3,839,041 | A | 10/1974 | Hiller |
| 3,844,797 | A | 10/1974 | Heugebaert et al. |
| 3,951,660 | A | 4/1976 | Hagemann |
| 4,082,901 | A | 4/1978 | Laridon et al. |
| 4,245,033 | A | 1/1981 | Eida et al. |
| 4,728,600 | A | 3/1988 | Hara et al. |
| 5,082,763 | A | 1/1992 | Kojima et al. |
| 5,084,376 | A | 1/1992 | Suda et al. |
| 5,464,738 | A | 11/1995 | Lynch et al. |
| 5,496,695 | A | 3/1996 | Simpson et al. |
| 5,545,505 | A | 8/1996 | Simpson |
| 5,545,507 | A | 8/1996 | Simpson et al. |
| 5,545,515 | A | 8/1996 | Murray et al. |
| 5,558,983 | A | 9/1996 | Simpson et al. |
| 5,599,647 | A | 2/1997 | Defieuw et al. |
| 5,635,339 | A | 6/1997 | Murray |

(Continued)

FOREIGN PATENT DOCUMENTS

DE 25 58 951 A1 7/1976

(Continued)

OTHER PUBLICATIONS

Cohen et al., *Modern Coating and Drying Technology*, (1992).

(Continued)

*Primary Examiner*—Richard L. Schilling
(74) *Attorney, Agent, or Firm*—Leydig, Voit & Mayer, Ltd.

(57) ABSTRACT

A substantially light-insensitive black and white monosheet thermographic recording material comprising a support and a thermosensitive element, said thermosensitive element containing a substantially light-insensitive organic silver salt, an organic reducing agent therefor in thermal working relationship therewith, at least one binder and at least one stabilizer represented by formula (I):

(I)

wherein $R^1$, $R^2$, $R^3$ and $R^4$ are independently selected from the group consisting of a hydrogen atom, halogen atoms and aliphatic, alkoxy, nitro, acyl, sulfonyl, nitrile, alkaryl, aryl, amino, thioalkyl, aldehyde, urea, —O—(C═O)-alkyl, —O—(C═O)-aryl, —O—(C═O)—O-alkyl, —O—(C═O)—O-aryl, —NH—(C═O)-alkyl, —NH—(C═O)-aryl, —(C═O)—NH-alkyl, —(C═O)—NH-aryl, —NH—($SO_2$)-alkyl, —NH—($SO_2$)-aryl, —($SO_2$)—NH-alkyl, —($SO_2$)—NH-aryl groups; X is represented by -A(-M)$_n$ or is selected from the group consisting of substituted aliphatic groups, unsubstituted aliphatic groups, substituted cycloaliphatic groups, unsubstituted cycloaliphatic groups, substituted aromatic groups and unsubstituted aromatic groups where in each of said groups one or more of the chain or ring carbon atoms may be substituted by one of more atoms selected from the group consisting of S, O, Si, N and P atoms; n is 2, 3 or 4; A is selected from the group consisting of substituted aliphatic groups, unsubstituted aliphatic groups, substituted cycloaliphatic groups, unsubstituted cycloaliphatic groups, substituted aromatic groups and unsubstituted aromatic groups where in each of said groups one or more of the chain or ring carbon atoms may be substituted by one of more atoms selected from the group consisting of S, O, Si, N and P atoms; each (-M) is independently a substituted or unsubstituted group selected from the group consisting of -(2-S-imidazole) groups and -(2-S-imidazole) groups annelated with an aromatic ring system, the optional substituents for -M being selected from the group consisting of halogen atoms and aliphatic, alkoxy, nitro, acyl, sulfonyl, nitrile, alkaryl and aryl groups.

24 Claims, No Drawings

U.S. PATENT DOCUMENTS

| | | | | |
|---|---|---|---|---|
| 5,654,130 | A | 8/1997 | Murray | |
| 6,348,308 | B1 | 2/2002 | Loccufier et al. | |
| 6,586,170 | B1 | 7/2003 | Yamada et al. | |
| 6,902,880 | B1 * | 6/2005 | Geuens et al. | 430/618 |
| 2004/0002027 | A1 | 1/2004 | Yamada et al. | |
| 2005/0003298 | A1 * | 1/2005 | Uyttendaele et al. | 430/270.1 |
| 2005/0003315 | A1 | 1/2005 | Uyttendaele et al. | |
| 2005/0053871 | A1 * | 3/2005 | Defieuw et al. | 430/351 |

FOREIGN PATENT DOCUMENTS

| | | | |
|---|---|---|---|
| EP | 0 353 724 | A1 | 2/1990 |
| EP | 0 622 217 | A1 | 11/1994 |
| EP | 0 654 355 | A1 | 5/1995 |
| EP | 0 692 733 | A2 | 1/1996 |
| EP | 0 736 799 | A1 | 10/1996 |
| EP | 0 897 130 | A1 | 2/1999 |
| EP | 0 901 040 | A1 | 3/1999 |
| EP | 0 903 625 | A1 | 3/1999 |
| EP | 0 964 300 | A1 | 12/1999 |
| EP | 1 143 292 | A2 | 10/2001 |
| EP | 1 241 520 | A2 | 9/2002 |
| EP | 1 278 101 | A2 | 1/2003 |
| EP | 1 484 641 | A1 | 12/2004 |
| EP | 1 484 642 | A1 | 12/2004 |
| GB | 1439478 | | 6/1976 |
| JP | 62 161144 | A1 | 1/1986 |
| JP | 2001 013618 | | 1/2001 |

OTHER PUBLICATIONS

Search Report for EP 04102147 (Oct. 5, 2004).

* cited by examiner

STABILIZERS FOR USE IN SUBSTANTIALLY LIGHT-INSENSITIVE THERMOGRAPHIC RECORDING MATERIALS

CROSS-REFERENCE TO RELATED PATENT APPLICATIONS

This application claims the benefit of U.S. Provisional Application No. 60/576,438 filed Jun. 3, 2004, which is incorporated by reference. In addition, this application claims the benefit of European Application No. 04102147.8 filed May 17, 2004, which is also incorporated by reference.

FIELD OF THE INVENTION

The present invention concerns stabilizers for use in substantially light-insensitive thermographic recording materials.

BACKGROUND OF THE INVENTION

Thermography is an image-forming process including a heating step and hence includes photothermography in which the image-forming process includes image-wise exposure and direct thermal processes in which the image-forming process includes an image-wise heating step. In direct thermal printing a visible image pattern is produced by image-wise heating of a recording material.

EP-A 0 901 040 discloses a substantially light-insensitive monosheet recording material comprising a support and a thermosensitive element containing a substantially light-insensitive organic silver salt, an organic reducing agent therefor in thermal working relationship therewith and a binder, characterized in that said thermosensitive element further contains an unsaturated carbocyclic or heterocyclic stabilizer compound substituted with a —SA group where A is hydrogen, a counterion to compensate the negative charge of the thiolate group or a group forming a symmetrical or an asymmetrical disulfide and said recording material is capable of producing prints with a numerical gradation value defined as the quotient of the fraction $(2.5-0.1)/(E_{2.5}-E_{0.1})$ greater than 2.3, where $E_{2.5}$ is the energy in Joule applied in a dot area of 87 μm×87 μm of the imaging layer that produces an optical density value of 2.5, and $E_{0.1}$ is the energy in Joule applied in a dot area of the imaging layer material that produces an optical density value of 0.1.

EP-A 0 897 130 discloses a thermographic recording element having at least one image forming layer, said element comprising an organic silver salt, a reducing agent, and at least one of the substituted alkene derivatives of the general formulae (1) through (14):

formula (1)

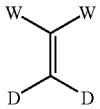

formula (2)

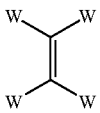

-continued formula (3)

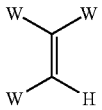

formula (4)

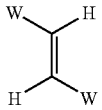

formula (5)

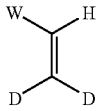

formula (6)

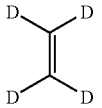

formula (7)

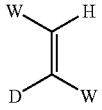

formula (8)

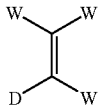

formula (9)

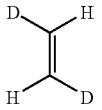

formula (10)

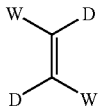

formula (11)

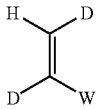

formula (12)

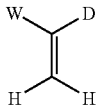

formula (13)

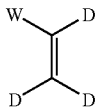

formula (14)

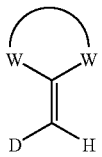

wherein W is an electron attractive group, D is an electron donative group, H is hydrogen, the groups represented by W or D attached to the same carbon atom, taken together, may form a cyclic structure, the compound may assume either a trans or cis structure when both trans and cis structures are possible with respect to W or D, and two W groups in formula (14) form a cyclic structure.

U.S. Pat. No. 3,839,041 discloses a photothermographic element comprising a support having thereon photosensitive silver halide in association with an oxidation-reduction image-forming combination comprising (i) a heavy metal salt oxidizing agent with (ii) a reducing agent, a binder, and a stabilizer precursor which is a compound of the formula:

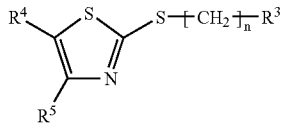

Wherein $R^3$ is acetyl, propionyl, butyryl, pentanoyl, carboxy, cyano, aroyl containing up to 13 carbon atoms, or furyl; $R^5$ is alkyl containing one to five carbon atoms, carboxy, aryl containing six to 12 carbon atoms, or hydrogen; $R^4$ is alkyl containing one to five carbon atoms, carboxy, or hydrogen; n is 0 or 2.

Differences between substantially light-insensitive thermographic recording materials and photothermographic recording materials The technology of substantially light-insensitive thermographic materials in which image formation is based on the reduction of organic silver salts is significantly different from that of photothermographic recording materials, despite the fact that in both cases the image results from the reduction of organic silver salts. However, this a superficial similarity masking the fact that the realization of the species which catalyze this reduction is completely different, being image-wise exposure of photosensitive silver halide-containing photo-addressable thermally developable elements in the case of photothermographic recording materials and image-wise heating of thermosensitive elements which do not contain photosensitive silver halide in the case of thermographic recording materials. This difference in technology is further underlined by the nature of the ingredients used in the two types of materials, the most significant difference being the absence of photosensitive silver halide and spectral sensitizing agents in substantially light-insensitive thermographic recording materials, but also reflected in the different reducing agents used, stronger reducing agents being used in substantially light-insensitive thermographic recording materials, the different stabilizers, the different toning agents etc. Furthermore, the thermal development processes themselves are significantly different in that the whole material is heated at temperatures of less than 150° C. for periods of seconds (e.g. 10 s) in the case of photothermographic recording materials, whereas in the case of substantially light-insensitive thermographic recording materials the materials are image-wise heated at much higher temperatures for periods of ms (e.g. 10–20 ms). Realization of a neutral image tone is a major problem in the case of substantially light-insensitive thermographic recording materials due to the very short heating times, whereas it is much less of a problem in photothermographic recording materials due to the much longer heating times.

Problem to be Solved

Substantially light-insensitive thermographic recording materials contain the imaging-forming components both before and after image formation and unwanted image-forming must be hindered both during storage prior to printing and in prints exposed to light on light-boxes e.g. during examination by radiologists. Furthermore, such stabilization must take place without adverse effects upon the image quality particularly the image tone. There is therefore a need for stabilizers which fulfil these requirements.

ASPECTS OF THE INVENTION

It is therefore an aspect of the present invention to provide stabilizers which endow substantially light-insensitive thermographic recording materials with improved image tone stability of the image background upon exposure to light, particularly in respect of b* CIELAB values.

It is therefore a further aspect of the present invention to provide stabilizers which endow substantially light-insensitive thermographic recording materials suitable with improved image tone stability of the image background after storage, particularly in respect of b* CIELAB values.

Further aspects and advantages of the invention will become apparent from the description hereinafter.

SUMMARY OF THE INVENTION

It has been surprisingly found that the incorporation of at least one stabilizer represented by formula (I):

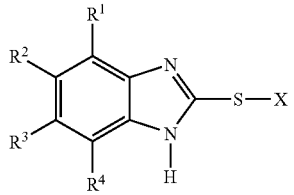

(I)

wherein $R^1$, $R^2$, $R^3$ and $R^4$ are independently selected from the group consisting of a hydrogen atom, halogen atoms and aliphatic, alkoxy, nitro, acyl, sulfonyl, nitrile, alkaryl, aryl, amino, thioalkyl, aldehyde, urea, —O—(C═O)-alkyl, —O—(C═O)-aryl, —O—(C═O)—O-alkyl, —O—(C═O)—O-aryl, —NH—(C═O)-alkyl, —NH—(C═O)-aryl, —(C═O)—NH-alkyl, —(C═O)—NH-aryl, —NH—($SO_2$)-alkyl, —NH—($SO_2$)-aryl, —($SO_2$)—NH-alkyl, —($SO_2$)—NH-aryl groups; X is represented by -A(-M)$_n$ or is selected from the group consisting of substituted aliphatic groups, unsubstituted aliphatic groups, substituted cycloaliphatic groups, unsubstituted cycloaliphatic groups, substituted aromatic groups and unsubstituted aromatic groups where in each of said groups one or more of the chain or ring carbon atoms may be substituted by one of more atoms selected from the group consisting of S, O, Si, N and P atoms; n is 2, 3 or 4; A is selected from the group consisting of substituted aliphatic groups, unsubstituted aliphatic groups, substituted cycloaliphatic groups, unsubstituted cycloaliphatic groups, substituted aromatic groups and unsubstituted aromatic groups where in each of said groups one or more of the chain or ring carbon atoms may be substituted by one of more atoms selected from the group consisting of S, O, Si, N and P atoms; each (-M) is independently a substituted or unsubstituted group selected from the group consisting of -(2-S-imidazole) groups and -(2-S-imidazole) groups annelated with an aromatic ring system, the optional substituents for -M being selected from the group consisting of s halogen atoms and aliphatic, alkoxy, nitro, acyl, sulfonyl, nitrile, alkaryl and aryl groups, into thermosensitive elements of substantially light-insensitive thermographic recording materials results in a substantial improvement in image tone stability upon exposure to visible light as characterized by CIELAB a* and b* values. The L*, a* and b* CIELAB-values were determined by spectrophotometric measurements according to ASTM Norm E179-90 in a R(45/0) geometry with evaluation according to ASTM Norm E308-90.

Aspects of the present invention are realized with a substantially light-insensitive black and white monosheet thermographic recording material comprising a support and a thermosensitive element, said thermosensitive element containing a substantially light-insensitive organic silver salt, an organic reducing agent therefor in thermal working relationship therewith, at least one binder and at least one stabilizer represented by formula (I)

(I)

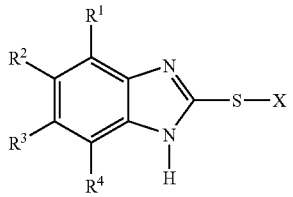

wherein $R^1$, $R^2$, $R^3$ and $R^4$ are independently selected from the group consisting of a hydrogen atom, halogen atoms and aliphatic, alkoxy, nitro, acyl, sulfonyl, nitrile, alkaryl, aryl, amino, thioalkyl, aldehyde, urea, —O—(C═O)-alkyl, —O—(C═O)-aryl, —O—(C═O)—O-alkyl, —O—(C═O) —O-aryl, —NH—(C═O)-alkyl, —NH—(C═O)-aryl, —(C═O)—NH-alkyl, —(C═O)—NH-aryl, —NH—($SO_2$)-alkyl, —NH—($SO_2$)-aryl, —($SO_2$)—NH-alkyl, —($SO_2$)—NH-aryl groups; X is represented by -A(-M)$_n$ or is selected from the group consisting of substituted aliphatic groups, unsubstituted aliphatic groups, substituted cycloaliphatic groups, unsubstituted cycloaliphatic groups, substituted aromatic groups and unsubstituted aromatic groups where in each of said groups one or more of the chain or ring carbon atoms may be substituted by one of more atoms selected from the group consisting of S, O, Si, N and P atoms; n is 2, 3 or 4; A is selected from the group consisting of substituted aliphatic groups, unsubstituted aliphatic groups, substituted cycloaliphatic groups, unsubstituted cycloaliphatic groups, substituted aromatic groups and unsubstituted aromatic groups where in each of said groups one or more of the chain or ring carbon atoms may be substituted by one of more atoms selected from the group consisting of S, O, Si, N and P atoms; each (-M) is independently a substituted or unsubstituted group selected from the group consisting of -(2-S-imidazole) groups and -(2-S-imidazole) groups annelated with an aromatic ring system, the optional substituents for -M being selected from the group consisting of halogen atoms and aliphatic, alkoxy, nitro, acyl, sulfonyl, nitrile, alkaryl and aryl groups.

Preferred embodiments of the present invention are disclosed in the detailed description of the invention.

DETAILED DESCRIPTION OF THE INVENTION

Definitions

The term alkyl means all variants possible for each number of carbon atoms in the alkyl group i.e. for three carbon atoms: n-propyl and isopropyl; for four carbon atoms: n-butyl, isobutyl and tertiary-butyl; for five carbon atoms: n-pentyl, 1,1-dimethylpropyl, 2,2-dimethylpropyl and 2-methyl-butyl etc.

The term acyl group as used in disclosing the present invention means —(C═O)-aryl and —(C═O)-alkyl groups.

The term disulfide as used in disclosing the present invention means one of a group or organosulfur compounds RSSR' that may be symmetrical (R═R') or unsymmetrical (R and R', different).

The L*, a* and b* CIELAB-values are defined in ASTM Norm E179-90 in a R(45/0) geometry with evaluation according to ASTM Norm E308-90.

Substantially light-insensitive means not intentionally light sensitive.

Thermosensitive Element

The term thermosensitive element as used herein is that element which contains all the ingredients which contribute to image formation. According to the present invention, the thermosensitive element contains one or more substantially light-insensitive organic silver salts, one or more reducing agents therefor in thermal working relationship therewith and at least one binder. The element may comprise a layer system in which the above-mentioned ingredients may be dispersed in different layers, with the proviso that the substantially light-insensitive organic silver salts are in reactive association with the reducing agents i.e. during the thermal development process the reducing agent must be present in such a way that it is able to diffuse to the particles of substantially light-insensitive organic silver salt so that reduction to silver can occur.

The thermosensitive element of the substantially light-insensitive black and white monosheet thermographic recording material, according to the present invention, preferably excludes at least one of the substituted alkene derivatives of the general formulae (1) through (14):

formula (1)

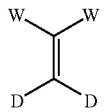

formula (2)

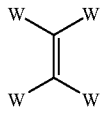

formula (3)

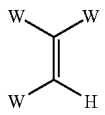

formula (4)

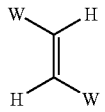

formula (5)

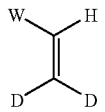

-continued formula (6)

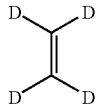

formula (7)

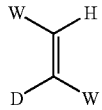

formula (8)

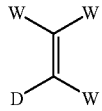

formula (9)

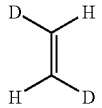

formula (10)

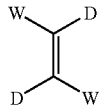

formula (11)

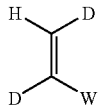

formula (12)

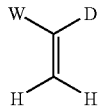

formula (13)

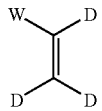

formula (14)

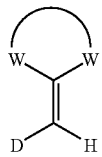

wherein W is an electron attractive group, D is an electron donative group, H is hydrogen, the groups represented by W or D attached to the same carbon atom, taken together, may form a cyclic structure, the compound may assume either a trans or cis structure when both trans and cis structures are possible with respect to W or D, and two W groups in formula (14) form a cyclic structure.

The substantially light-insensitive black and white monosheet thermographic recording material, according to the present invention, includes the possibility of one or more substantially light-insensitive organic silver salts and/or one of more organic reducing agents therefor being encapsulated in heat-responsive microcapsules, such as disclosed in EP-A 0 736 799 herein incorporated by reference.

Compounds According to Formula (I)

Aspects of the present invention are realized with a substantially light-insensitive black and white monosheet thermographic recording material comprising a support and a thermosensitive element, said thermosensitive element containing a substantially light-insensitive organic silver salt, an organic reducing agent therefor in thermal working relationship therewith, at least one binder and at least one stabilizer represented by formula (I):

(I)

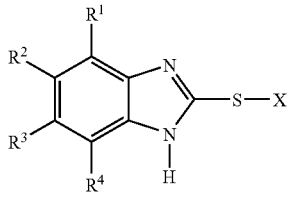

wherein $R^1$, $R^2$, $R^3$ and $R^4$ are independently selected from the group consisting of a hydrogen atom, halogen atoms and aliphatic, alkoxy, nitro, acyl, sulfonyl, nitrile, alkaryl, aryl, amino, thioalkyl, aldehyde, urea, —O—(C═O)-alkyl, —O—(C═O)-aryl, —O—(C═O)—O-alkyl, —O—(C═O)—O-aryl, —NH—(C═O)-alkyl, —NH—(C═O)-aryl, —(C═O)—NH-alkyl, —(C═O)—NH-aryl, —NH—($SO_2$)-alkyl, —NH—($SO_2$)-aryl, —($SO_2$)—NH-alkyl, —($SO_2$)—NH-aryl groups; X is represented by -A(-M)$_n$ or is selected from the group consisting of substituted aliphatic groups, unsubstituted aliphatic groups, substituted cycloaliphatic groups, unsubstituted cycloaliphatic groups, substituted aromatic groups and unsubstituted aromatic groups where in each of said groups one or more of the chain or ring carbon atoms may be substituted by one of more atoms selected from the group consisting of S, O, Si, N and P atoms; n is 2, 3 or 4; A is selected from the group consisting of substituted aliphatic groups, unsubstituted aliphatic groups, substituted cycloaliphatic groups, unsubstituted cycloaliphatic groups, substituted aromatic groups and unsubstituted aromatic groups where in each of said groups one or more of the chain or ring carbon atoms may be substituted by one of more atoms selected from the group consisting of S, O, Si, N and P atoms; each (-M) is independently a substituted or unsubstituted group selected from the group consisting of -(2-S-imidazole) groups and -(2-S-imidazole) groups annelated with an aromatic ring system, the optional substituents for -M being selected from the group consisting of halogen atoms and aliphatic, alkoxy, nitro, acyl, sulfonyl, nitrile, alkaryl and aryl groups. X, according to formula (I), cannot be hydrogen, a counterion to compensate the negative charge of the thiolate group or a group forming a symmetrical or an asymmetrical disulfide.

According to a first embodiment of the substantially light-insensitive black and white monosheet thermographic recording material, according to the present invention, in the at least one stabilizer represented by formula (I) n is at least 1.

According to a second embodiment of the substantially light-insensitive black and white monosheet thermographic recording material, according to the present invention, in the at least one stabilizer represented by formula (I) A is selected from the group consisting of an optionally substituted alkyl groups, optionally substituted alkenyl groups, optionally substituted alkynyl groups, optionally substituted alkyaryl groups, optionally substituted alkyl-heterocyclic groups, optionally substituted alkyl-heteroaromatic groups, optionally substituted alkyl groups in which at least one of the non-terminal main chain carbon atoms is substituted with an oxygen or a sulfur atom, optionally substituted aryl groups, optionally substituted alkyl-aryl-alkyl groups, optionally substituted alkyl-heteroaryl-alkyl groups, optionally substituted alkyl-COO-alkyl-OOC-alkyl groups, optionally substituted alkyl-O—COO-alkyl groups, optionally substituted alkyl-CONH-alkyl groups, and optionally substituted alkyl-COO-aryl-OOC-alkyl groups. Preferred substituents for the alkyl, aryl and heteroaryl groups include alkyl, alkoxy, —S-alkyl, hydroxy and mercapto groups.

According to a third embodiment of the substantially light-insensitive black and white monosheet thermographic recording material, according to the present invention, in the at least one stabilizer represented by formula (I) X is -A-M and -M is a -(2-S-imidazole) group or a -(2-S-imidazole) group annelated with an aromatic ring system.

According to a fourth embodiment of the substantially light-insensitive black and white monosheet thermographic recording material, according to the present invention, in the at least one stabilizer represented by formula (I) X is -A-$(CH_2)_m$-M, wherein m is 2 to 20 and -M is a -(2-S-imidazole) group or a -(2-S-imidazole) group annelated with an aromatic ring system.

According to a fifth embodiment of the substantially light-insensitive black and white monosheet thermographic recording material, according to the present invention, in the at least one stabilizer represented by formula (I) X is -A-$(CH_2)_m$-M, wherein m is 4 to 9 and -M is a -(2-S-imidazole) group or a -(2-S-imidazole) group annelated with an aromatic ring system.

According to a sixth embodiment of the substantially light-insensitive black and white monosheet thermographic recording material, according to the present invention, the at least one stabilizer represented by formula (I) is selected from the group consisting of:

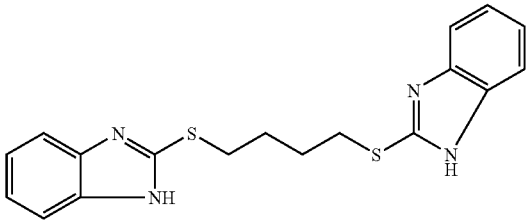

;

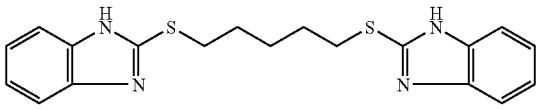

;

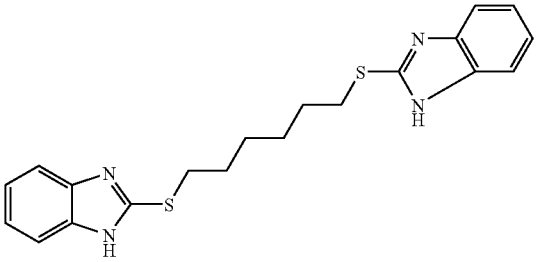

;

-continued

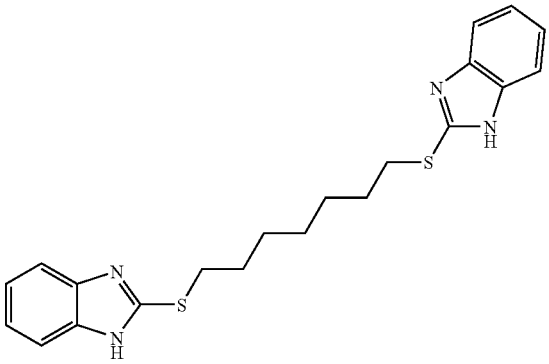

;

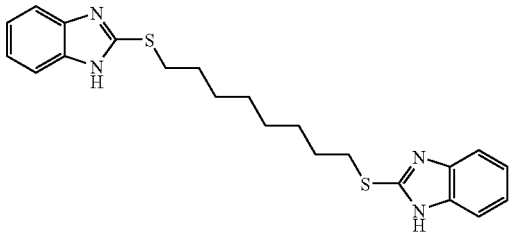

; and

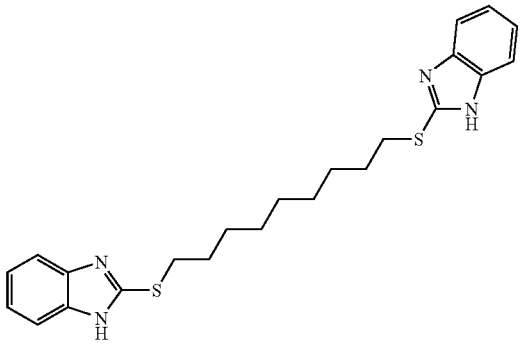

According to a seventh embodiment of the substantially light-insensitive black and white monosheet thermographic recording material, according to the present invention, the at least one stabilizer represented by formula (I) is selected from the group consisting of:

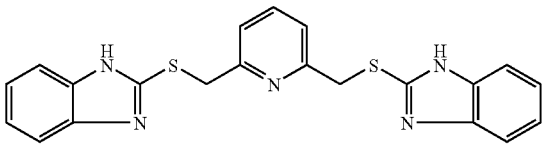

;

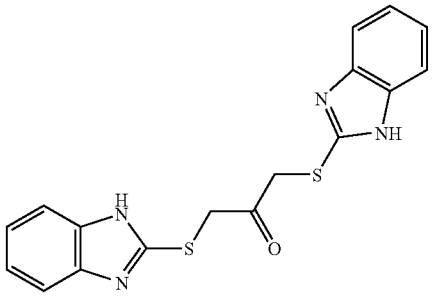

;

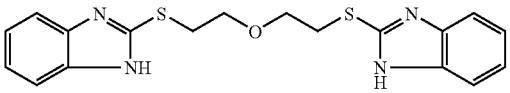

; and

-continued

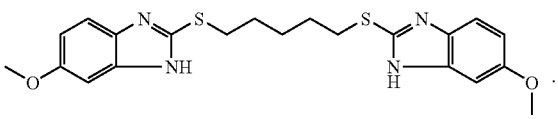

Compounds represented by formula (I), according to the present invention, can be prepared from readily available starting materials using standard organic chemistry techniques known to one skilled in the art and available in such reference books as Houben-Weyl.

Suitable compounds represented by formula (I), according to the present invention, include:

| | Structure |
|---|---|
| MBIZ-1 | 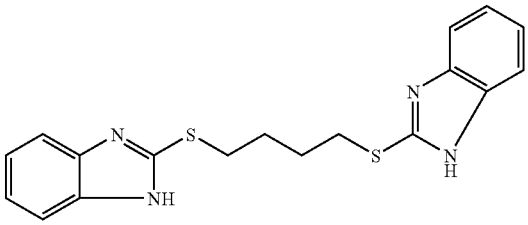 |
| MBIZ-2 | 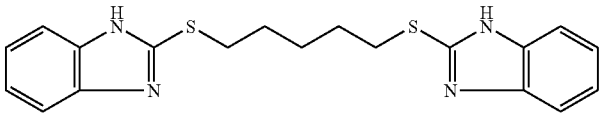 |
| MBIZ-3 | 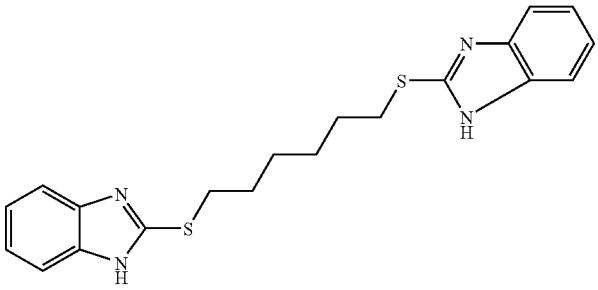 |
| MBIZ-4 | 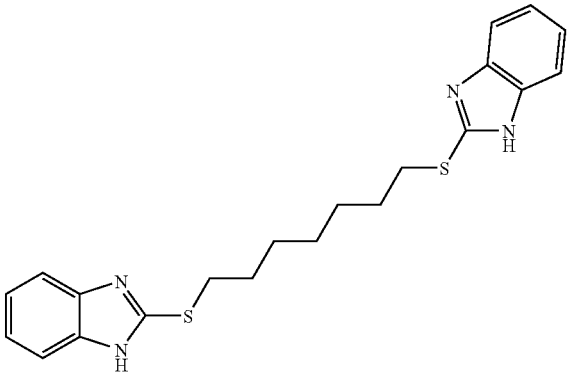 |
| MBIZ-5 | 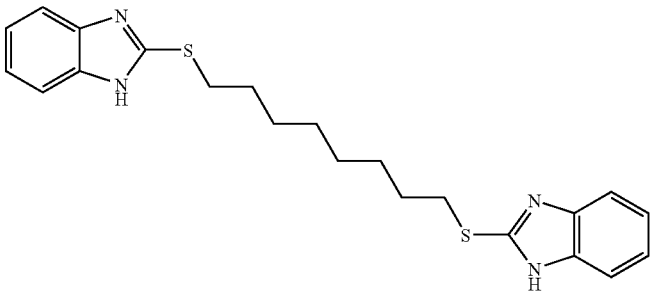 |

-continued
| | Structure |
|---|---|
| MBIZ-6 | 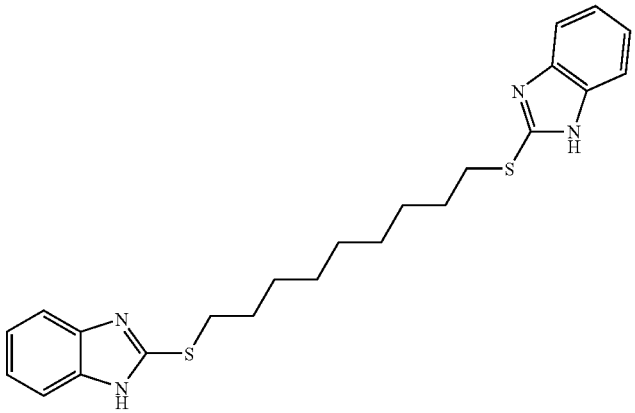 |
| MBIZ-7 | 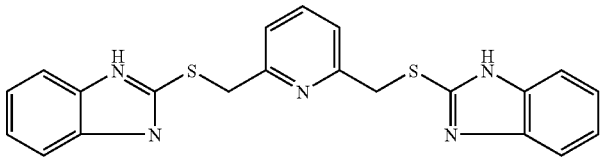 |
| MBIZ-8 | 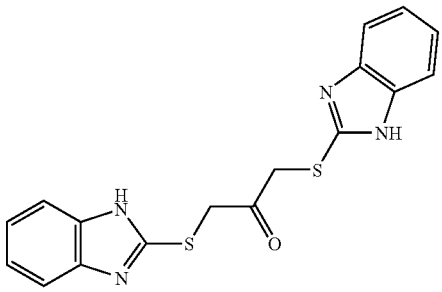 |
| MBIZ-9 | 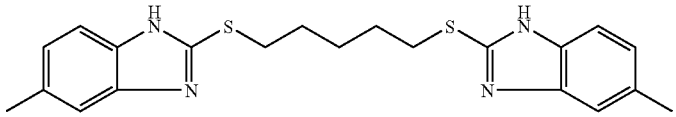 |
| MBIZ-10 | 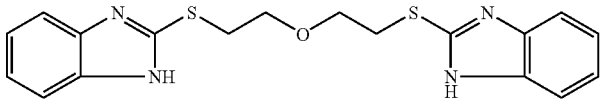 |
| MBIZ-11 | 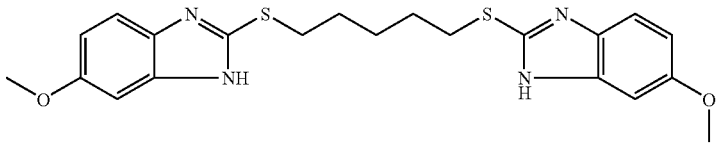 |
| MBIZ-12 | 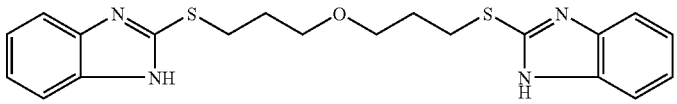 |
| MBIZ-13 | 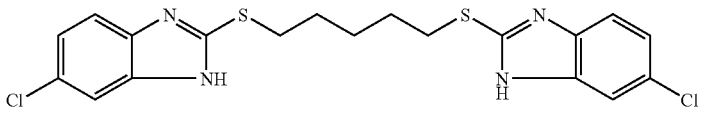 |

-continued

| | Structure |
|---|---|
| MMIZ-1 | 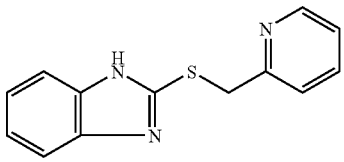 |
| MMIZ-2 | 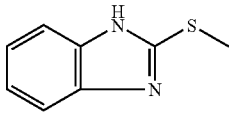 |
| MMIZ-3 | 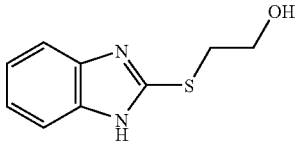 |
| MMIZ-4 | 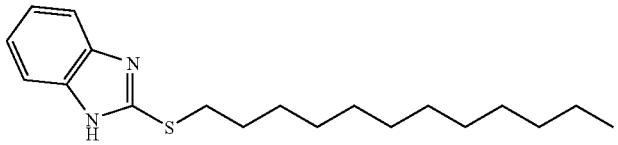 |
| MMIZ-5 | 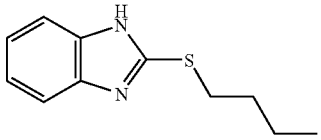 |
| MMIZ-6 | 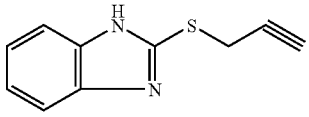 |

Organic Silver Salt

According to an eighth embodiment of the substantially light-insensitive black and white monosheet thermographic recording material, according to the present invention, the organic silver salts are not double organic salts containing a silver cation associated with a second cation e.g. magnesium or iron ions.

According to a ninth embodiment of the substantially light-insensitive black and white monosheet thermographic recording material of the present invention, at least one of the organic silver salts is a substantially light-insensitive silver salt of an organic carboxylic acid.

According to a tenth embodiment of the substantially light-insensitive black and white monosheet thermographic recording material of the present invention, at least one of the organic silver salts is a substantially light-insensitive silver salt of an aliphatic carboxylic acids known as a fatty acid, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Other silver salts of an organic carboxylic acid as described in GB-P 1,439,478, e.g. silver benzoate, may likewise be used to produce a thermally developable silver image. Combinations of different silver salt of an organic carboxylic acids may also be used in the present invention, as disclosed in EP-A 964 300.

Organic silver salts may be dispersed by standard dispersion techniques. Ball mills, bead mills, microfluidizers, ultrasonic apparatuses, rotor stator mixers etc. have been found to be useful in this regard. Mixtures of organic silver salt dispersions produced by different techniques may also be used to obtain the desired thermographic properties e.g. of coarser and more finely ground dispersions of organic silver salts.

Reducing Agents

According to an eleventh embodiment of the black and white thermographic recording material, according to the present invention, the reducing agent is an organic compound containing at least one active hydrogen atom linked to O, N or C, such as is the case with, aromatic di- and tri-hydroxy compounds. 1,2-dihydroxybenzene derivatives, such as catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid esters are preferred, with those described in EP-A 0 692 733 and EP-A 0 903 625 being particularly preferred.

Combinations of reducing agents may also be used that on heating become reactive partners in the reduction of the one or more substantially light-insensitive organic silver salt. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents as disclosed in U.S. Pat. No. 5,545,505, U.S. Pat. No. 5,545,507 and U.S. Pat. No. 5,558,983; acrylonitrile compounds as disclosed in U.S. Pat. No. 5,545,515 and U.S. Pat. No. 5,635,339; and 2-substituted malonodialdehyde compounds as disclosed in U.S. Pat. No. 5,654,130.

Binder of the Thermosensitive Element

The film-forming binder of the thermosensitive element may be all kinds of natural, modified natural or synthetic resins or mixtures of such resins, in which the at least one organic silver salt can be dispersed homogeneously either in aqueous or solvent media: e.g. cellulose derivatives, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylates, polymethacrylates, polystyrene and polyethylene or mixtures thereof.

According to an eleventh embodiment of the black and white thermographic recording material, according to the present invention, the at least one binder comprises at least one first polymer consisting of vinyl aceto-acetal monomer units and monomer units selected from the group consisting of vinyl butyral, vinyl alcohol, vinyl acetate and itaconic acid monomer units, wherein the weight ratio of the at least one binder to said light-insensitive silver salt(s) of a carboxylic acid in said thermosensitive element is greater than 1.5; and the at least one binder optionally contains less than 40% by weight of a second polymer consisting of vinyl butyral monomer units and optionally vinyl alcohol and/or vinyl acetate monomer units.

Suitable water-soluble film-forming binders for use in thermographic recording materials according to the present invention are: polyvinyl alcohol, polyacrylamide, polymethacrylamide, polyacrylic acid, polymethacrylic acid, polyvinylpyrrolidone, polyethyleneglycol, proteinaceous binders, polysaccharides and water-soluble cellulose derivatives. A preferred water-soluble binder for use in the thermographic recording materials of the present invention is gelatine.

The binder to organic silver salt weight ratio is preferably in the range of 0.2 to 7, and the thickness of the thermosensitive element is preferably in the range of 5 to 50 μm. Binders are preferred which do not contain additives, such as certain antioxidants (e.g. 2,6-di-tert-butyl-4-methylphenol), or impurities which adversely affect the thermographic properties of the thermographic recording materials in which they are used.

Toning Agent

According to a twelfth embodiment of the black and white monosheet thermographic recording material, according to the present invention, the thermosensitive element contains a toning agent, which enables a neutral black image tone to be obtained in the higher densities and neutral grey in the lower densities.

According to a thirteenth embodiment of the black and white monosheet thermographic recording material, according to the present invention, the thermosensitive element further contains a toning agent selected from the group consisting of phthalimides, phthalazinones, benzoxazine diones and naphthoxazine diones e.g. phthalimides and phthalazinones within the scope of the general formulae described in U.S. Pat. No. 4,082,901; the toning agents described in U.S. Pat. Nos. 3,074,809, 3,446,648 and 3,844,797; and the heterocyclic toner compounds of the benzoxazine dione or naphthoxazine dione type as disclosed in GB 1,439,478, U.S. Pat. No. 3,951,660 and U.S. Pat. No. 5,599,647, herein incorporated by reference.

According to a fourteenth embodiment of the substantially light-insensitive black and white monosheet thermographic recording material, according to the present invention, the substantially light-insensitive thermographic recording material contains a thermosensitive element, the thermosensitive element containing one or more toning agents selected from the group consisting of phthalazinone, benzo[e][1,3]oxazine-2,4-dione, 7-methyl-benzo[e][1,3]oxazine-2,4-dione, 7-methoxy-benzo[e][1,3]oxazine-2,4-dione and 7-(ethylcarbonato)-benzo[e][1,3]oxazine-2,4-dione.

Auxiliary Antifoggants

According to a fifteenth embodiment of the black and white monosheet thermographic recording material, according to the present invention, the thermographic recording material further contains an auxiliary antifoggant to obtain improved shelf-life and reduced fogging.

According to a sixteenth embodiment of the black and white monosheet thermographic recording material, according to the present invention, the thermographic recording material further contains an antifoggant selected from the group consisting of benzotriazole, substituted benzotriazoles and aromatic polycarboxylic acid such as ortho-phthalic acid, 3-nitro-phthalic acid, tetrachlorophthalic acid, mellitic acid, pyromellitic acid and trimellitic acid and anhydrides thereof.

According to a seventeenth embodiment of the black and white monosheet thermographic recording material, according to the present invention, the thermosensitive element further contains an optionally substituted benzotriazole.

Polycarboxylic Acids and Anhydrides Thereof

According to an eighteenth embodiment of the black and white monosheet thermographic recording material, according to the present invention, the thermosensitive element further contains at least one polycarboxylic acid and/or anhydride thereof in a molar percentage of at least 15 with respect to all the organic silver salt(s) present and in thermal working relationship therewith. The polycarboxylic acid may be aliphatic (saturated as well as unsaturated aliphatic and also cycloaliphatic) or an aromatic polycarboxylic acid, may be substituted and may be used in anhydride form or partially esterified on the condition that at least two free carboxylic acids remain or are available in the heat recording step.

Surfactants and Dispersants

Surfactants and dispersants aid the dispersion of ingredients which are insoluble in the particular dispersion medium. The substantially light-insensitive thermographic material used in the present invention may contain one or more surfactants, which may be anionic, non-ionic or cationic surfactants and/or one or more dispersants. Suitable dispersants are natural polymeric substances, synthetic polymeric substances and finely divided powders, e.g. finely divided non-metallic inorganic powders such as silica.

Support

According to a nineteenth embodiment of the substantially light-insensitive black and white monosheet thermographic recording material, according to the present invention, the support is transparent or translucent. It is preferably a thin flexible carrier made transparent resin film, e.g. made of a cellulose ester, e.g. cellulose triacetate, polypropylene, polycarbonate or polyester, e.g. polyethylene terephthalate. The support may be in sheet, ribbon or web form and subbed if needs be to improve the adherence to the thereon coated thermosensitive element. The support may be dyed or pigmented to provide a transparent coloured background for the image.

Protective Layer

According to a twentieth embodiment of the substantially light-insensitive black and white monosheet thermographic recording material, according to the present invention, the thermosensitive element is provided with a protective layer. In general this protects the thermosensitive element from atmospheric humidity and from surface damage by scratching etc. and prevents direct contact of printheads or heat sources with the recording layers. Protective layers for thermosensitive elements which come into contact with and have to be transported past a heat source under pressure, have to exhibit resistance to local deformation and good slipping characteristics during transport past the heat source during heating. A slipping layer, being the outermost layer, may comprise a dissolved lubricating material and/or particulate material, e.g. talc particles, optionally protruding from the outermost layer. Examples of suitable lubricating materials are a surface active agent, a liquid lubricant, a solid lubricant or mixtures thereof, with or without a polymeric binder.

Coating Techniques

The coating of any layer of the substantially light-insensitive thermographic material used in the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA. Coating may proceed from aqueous or solvent media with overcoating of dried, partially dried or undried layers.

Thermographic Processing

Thermographic imaging is carried out by the image-wise application of heat either in analogue fashion by direct exposure through an image or by reflection from an image, or in digital fashion pixel by pixel either by using an infra-red heat source, for example with a Nd-YAG laser or other infra-red laser, with a substantially light-insensitive thermographic recording material preferably containing an infra-red absorbing compound, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The operating temperature of common thermal printheads is in the range of 300 to 400° C. and the heating time per picture element (pixel) may be less than 1.0 ms, the pressure contact of the thermal printhead with the recording material being e.g. 200–1000 g/linear cm, i.e. with a contact zone (nip) of 200 to 300 μm a pressure of 5000 to 50,000 g/cm$^2$, to ensure a good transfer of heat.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet or web wherefrom during the heating no transfer of recording material can take place.

Activation of the heating elements can be power-modulated or pulse-length modulated at constant power. EP-A 654 355 discloses a method for making an image by image-wise heating by means of a thermal head having energizable heating elements, wherein the activation of the heating elements is executed duty cycled pulsewise. EP-A 622 217 discloses a method for making an image using a direct thermal imaging element producing improvements in continuous tone reproduction.

Image-wise heating of the recording material can also be carried out using an electrically resistive ribbon incorporated into the material. Image- or pattern-wise heating of the recording material may also proceed by means of pixel-wise modulated ultra-sound.

INDUSTRIAL APPLICATION

Thermographic imaging can be used for the production of reflection type prints and transparencies, in particular for use in the medical diagnostic field in which black-imaged transparencies are widely used in inspection techniques operating with a light box.

The invention is illustrated hereinafter by way of comparative examples and invention examples. The percentages and ratios given in these examples are by weight unless otherwise indicated.

Subbing layer Nr. 01 on the emulsion side of the support:

| | |
|---|---|
| copolymer of 88% vinylidene chloride, 10% methyl acrylate and 2% itaconic acid | 79.1 mg/m$^2$ |
| Kieselsol ® 100F, a colloidal silica from BAYER | 18.6 mg/m$^2$ |
| Mersolat ® H, a surfactant from BAYER | 0.4 mg/m$^2$ |
| Ultravon ® W, a surfactant from CIBA-GEIGY | 1.9 mg/m$^2$ |

Ingredients in the thermosensitive element in addition to the above-mentioned ingredients:

BL5HP=S-LEC BL5HP, a polyvinyl butyral from SEKISUI;

POLY 01=copolymer of 44% vinyl aceto-acetal, 38% vinyl butyral, 17% vinyl alcohol and 2% vinyl acetate (determined by $^{13}C$ NMR) with $M_w$=130,000, $M_n$=44,000 and $T_g$=89° C.

Oil=BAYSILON, a silicone oil from BAYER;

VL=DESMODUR VL, a 4,4'-diisocyanatodiphenylmethane from BAYER;

Reducing agents:

R01=3,4-dihydroxybenzonitrile;

R02=3,4-dihydroxybenzophenone;

Toning agent:

T01=7-(ethylcarbonato)-benzo[e][1,3]oxazine-2,4-dione;

T02=7-methyl-benzo[e][1,3]oxazine-2,4-dione;

Stabilizers:

Sol=glutaric acid

S02=tetrachlorophthalic acid anhydride

S03=benzotriazole

Additive:

A01 =

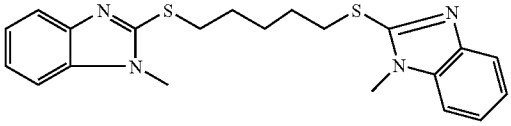

A02 =

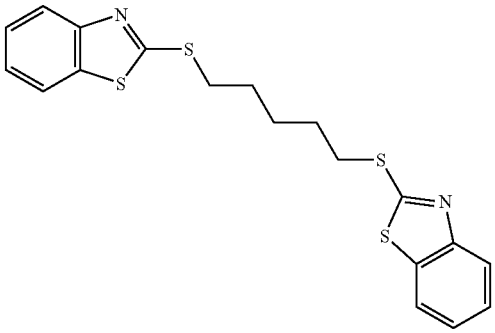

-continued

A03 =

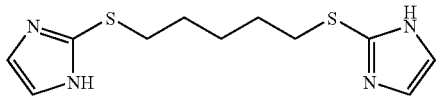

Ingredients in the protective layer:

ERCOL™ 48 20=a polyvinylalcohol from ACETEX EUROPE;

LEVASIL™ VP AC 4055=15% aqueous dispersion of colloidal silica with acid groups predominantly neutralized with $Na^+$ and a specific surface area of 500 $m^2/g$, from BAYER AG has been converted into ammonium salt;

ULTRAVON™ W=75–85% concentrate of a sodium arylsulfonate from Ciba Geigy converted into acid form by passing through an ion exchange column;

SYLOID™ 72=a silica from Grace;

SERVOXYL™ VPDZ 3/100=a mono[isotridecyl polyglycolether (3 EO)] phosphate, from SERVO DELDEN B.V.;

SERVOXYL™ VPAZ 100=a mixture of monolauryl and dilauryl phosphate, from SERVO DELDEN B.V.;

MICROACE TALC P3=an Indian talc from NIPPON TALC;

RILANIT™ GMS=a glycerine monotallow acid ester, from HENKEL

TMOS=tetramethylorthosilicate hydrolyzed in the presence of methanesulfonic acid.

INVENTION EXAMPLES 1 TO 16 AND COMPARATIVE EXAMPLES 1 TO 4

The substantially light-insensitive thermographic recording materials of INVENTION EXAMPLES 1 to 16 and COMPARATIVE EXAMPLES 1 to 4 were prepared by coating a dispersion with the following ingredients in 2-butanone onto a 175 μm thick blue-pigmented polyethylene terephthalate support with CIELAB a*- and b*-values of −9.5 and −17.9 respectively subbed on the emulsion-coated side with subbing layer 01 giving layers after drying at 50° C. for 1 h in a drying cupboard with the compositions given in Table 1.

TABLE 1

| | stabilizer | | | | R01 | R02 | T02 | S01 | S02 | | |
|---|---|---|---|---|---|---|---|---|---|---|---|
| | type | conc. mol % vs AgB | AgBeh coverage [g/m²] | BL5HP [g/m²] | mol % vs AgB | mol % vs AgB | mol % vs AgB | mol % vs AgB | mol % vs AgB | VL [g/m²] | Oil [g/m²] |
| Comparative example nr. | | | | | | | | | | | |
| 1 | — | — | 4.15 | 16.6 | 35 | 45 | 15 | 26 | 4.91 | 0.17 | 0.035 |
| 2 | A01 | 10 | 4.15 | 16.6 | 35 | 45 | 15 | 26 | 4.91 | 0.17 | 0.035 |
| 3 | A02 | 10 | 4.15 | 16.6 | 35 | 45 | 15 | 26 | 4.91 | 0.17 | 0.035 |
| 4 | A03 | 10 | 4.15 | 16.6 | 35 | 45 | 15 | 26 | 4.91 | 0.17 | 0.035 |
| Invention example nr. | | | | | | | | | | | |
| 1 | MBIZ-1 | 10 | 4.15 | 16.6 | 35 | 45 | 15 | 26 | 4.91 | 0.17 | 0.035 |
| 2 | MBIZ-2 | 10 | 4.15 | 16.6 | 35 | 45 | 15 | 26 | 4.91 | 0.17 | 0.035 |
| 3 | MBIZ-3 | 10 | 4.15 | 16.6 | 35 | 45 | 15 | 26 | 4.91 | 0.17 | 0.035 |
| 4 | MBIZ-4 | 10 | 4.15 | 16.6 | 35 | 45 | 15 | 26 | 4.91 | 0.17 | 0.035 |
| 5 | MBIZ-5 | 10 | 4.15 | 16.6 | 35 | 45 | 15 | 26 | 4.91 | 0.17 | 0.035 |
| 6 | MBIZ-6 | 10 | 4.15 | 16.6 | 35 | 45 | 15 | 26 | 4.91 | 0.17 | 0.035 |
| 7 | MBIZ-7 | 10 | 4.15 | 16.6 | 35 | 45 | 15 | 26 | 4.91 | 0.17 | 0.035 |
| 8 | MBIZ-8 | 10 | 4.15 | 16.6 | 35 | 45 | 15 | 26 | 4.91 | 0.17 | 0.035 |

TABLE 1-continued

| | stabilizer | | | | R01 | R02 | T02 | S01 | S02 | | |
|---|---|---|---|---|---|---|---|---|---|---|---|
| | type | conc. mol % vs AgB | AgBeh coverage [g/m²] | BL5HP [g/m²] | mol % vs AgB | mol % vs AgB | mol % vs AgB | mol % vs AgB | mol % vs AgB | VL [g/m²] | Oil [g/m²] |
| 9 | MBIZ-9 | 10 | 4.15 | 16.6 | 35 | 45 | 15 | 26 | 4.91 | 0.17 | 0.035 |
| 10 | MBIZ-10 | 10 | 4.15 | 16.6 | 35 | 45 | 15 | 26 | 4.91 | 0.17 | 0.035 |
| 11 | MBIZ-11 | 10 | 4.15 | 16.6 | 35 | 45 | 15 | 26 | 4.91 | 0.17 | 0.035 |
| 12 | MMIZ-1 | 10 | 4.15 | 16.6 | 35 | 45 | 15 | 26 | 4.91 | 0.17 | 0.035 |
| 13 | MMIZ-2 | 10 | 4.15 | 16.6 | 35 | 45 | 15 | 26 | 4.91 | 0.17 | 0.035 |
| 14 | MMIZ-4 | 10 | 4.15 | 16.6 | 35 | 45 | 15 | 26 | 4.91 | 0.17 | 0.035 |
| 15 | MMIZ-5 | 10 | 4.15 | 16.6 | 35 | 45 | 15 | 26 | 4.91 | 0.17 | 0.035 |
| 16 | MMIZ-6 | 10 | 4.15 | 16.6 | 35 | 45 | 15 | 26 | 4.91 | 0.17 | 0.035 |

The thermosensitive elements were then coated with an aqueous composition with the following ingredients, which was adjusted to a pH of 3.8 with 1N nitric acid, to a wet layer thickness of 85 μm and then dried at 50° C. for 15 minutes to produce a protective layer with the composition:

ERCOL™ 48 20=2.1 g/m²

LEVASIL™ VP AC 4055=1.05 g/m²

ULTRAVON™ W=0.075 g/m²

SYLOID™ 72=0.09 g/m²

SERVOXYL™ VPDZ 3/100=0.075 g/m²

SERVOXYL™ VPAZ 100=0.075 g/m²

MICROACE TALC P3=0.045 g/m²

RILANIT™ GMS=0.15 g/m²

TMOS=0.87 g/m² (assuming that the TMOS was completely converted to $SiO_2$)

After coating the protective layer was hardened by heating the substantially light-insensitive thermographic recording material at 45° C. for 7 days at a relative humidity of 70%.

Thermographic Printing

The substantially light-insensitive thermographic recording materials of INVENTION EXAMPLES 1 to 16 and COMPARATIVE EXAMPLES 1 to 4 were printed using a DRYSTAR™ 4500 printer from AGFA-GEVAERT with a resolution of 508 dpi which had been modified to operate at a printing speed of 14 mm/s and a line-time of 3.5 ms instead of 7.1 ms and in which the 75 μm long (in the transport direction) and 50 μm wide thermal head resistors were power-modulated to produce different image densities.

The maximum densities of the images ($D_{max}$) were measured through a visible filter with a MACBETH™ TR924 densitometer.

Evaluation of Thermographic Properties

The image tone of fresh prints made with the substantially light-insensitive thermographic recording materials of INVENTION EXAMPLES 1 to 16 and COMPARATIVE EXAMPLES 1 to 4 was assessed on the basis of the L*, a* and b* CIELAB-values at optical densities, D, of 1.0 and 2.0 and the results given in Table 2.

Light-box tests were performed by exposing the substantially light-insensitive thermographic materials of INVENTION EXAMPLES 1 to 16 and COMPARATIVE EXAMPLES 1 to 4 for 3 days on top of the white PVC window of a specially constructed light-box placed in a Votsch conditioning cupboard set at 30° C. and a relative humidity of 85%. Only a central area of the window 550 mm long by 500 mm wide was used for mounting the test materials to ensure uniform exposure.

The stainless steel light-box used was 650 mm long, 600 mm wide and 120 mm high with an opening 610 mm long and 560 mm wide with a rim 10 mm wide and 5 mm deep round the opening, thereby forming a platform for a 5 mm thick plate of white PVC 630 mm long and 580 mm wide, making the white PVC-plate flush with the top of the light-box and preventing light loss from the light-box other than through the white PVC-plate. This light-box was fitted with 9 Planilux™ TLD 36 W/54 fluorescent lamps 27 mm in diameter mounted length-wise equidistantly from the two sides, with the lamps positioned equidistantly to one another and the sides over the whole width of the light-box and with the tops of the fluorescent tubes 30 mm below the bottom of the white PVC plate and 35 mm below the materials being tested. The shifts in CIELAB a*- and b*-values at an optical density, D, of 1.0 and the shift in the CIELAB b*-value were determined for INVENTION EXAMPLES 1 to 16 and COMPARATIVE EXAMPLES 1 to 4 and the results are given in Table 2.

TABLE 2

| | stabilizer | | CIELAB-values of prints with fresh film | | | | | shift in b* CIELAB-values of prints after 3 d/30° C./85% RH light-box exposure | | |
|---|---|---|---|---|---|---|---|---|---|---|
| | | | Dmin | D = 1.0 | | D = 2.0 | | | | |
| | type | Dmax | b* | a* | b* | a* | b* | D = 1.0 | D = 2.0 | Dmin |
| Comparative Example nr. | | | | | | | | | | |
| 1 | — | 4.21 | −16.72 | −2.92 | −6.38 | −0.56 | −3.64 | +13.20 | +5.82 | +13.67 |
| 2 | A01 | 4.44 | −16.47 | −1.37 | −1.82 | −0.10 | +0.50 | +2.38 | +0.93 | +9.45 |

TABLE 2-continued

| | stabilizer | | CIELAB-values of prints with fresh film | | | | | shift in b* CIELAB-values of prints after 3 d/30° C./85% RH | | |
|---|---|---|---|---|---|---|---|---|---|---|
| | | | Dmin | D = 1.0 | | D = 2.0 | | light-box exposure | | |
| | type | Dmax | b* | a* | b* | a* | b* | D = 1.0 | D = 2.0 | Dmin |
| 3 | A02 | 4.24 | +17.07 | −3.55 | −7.30 | −1.26 | −4.81 | +7.59 | +3.11 | +14.98 |
| 4 | A03 | 3.56 | −16.77 | −2.68 | −9.21 | +0.24 | −7.00 | +2.22 | +0.62 | +11.03 |
| Invention Example nr | | | | | | | | | | |
| 1 | MBIZ-1 | 3.65 | −16.92 | −2.91 | −9.38 | −0.76 | −7.59 | +3.58 | +1.06 | +5.60 |
| 2 | MBIZ-2 | 3.32 | −17.3 | −3.56 | −7.42 | −0.79 | −6.42 | +1.40 | +0.93 | +4.47 |
| 3 | MBIZ-3 | 3.79 | −16.12 | −2.66 | −8.06 | −0.08 | −6.80 | +0.95 | +0.08 | +3.67 |
| 4 | MBIZ-4 | 3.49 | −16.02 | −1.90 | −8.99 | +1.21 | −7.16 | +2.90 | +1.99 | +4.02 |
| 5 | MBIZ-5 | 3.86 | −16.16 | −2.36 | −8.75 | −0.11 | −7.27 | +2.42 | +0.80 | +6.04 |
| 6 | MBIZ-6 | 3.63 | −16.02 | −2.47 | −8.91 | +0.16 | −7.18 | +2.10 | +1.24 | +4.24 |
| 7 | MBIZ-7 | 2.92 | −18.05 | −1.43 | −9.43 | −0.49 | −6.42 | +2.57 | +1.54 | +1.60 |
| 8 | MBIZ-8 | 3.17 | −13.7 | −2.25 | −6.74 | 0.84 | −5.54 | +3.06 | +1.82 | +2.11 |
| 9 | MBIZ-9 | 3.66 | −17.36 | −2.51 | −8.61 | 0.84 | −5.89 | +3.47 | +2.41 | +4.31 |
| 10 | MBIZ-10 | 3.62 | −16.99 | −1.47 | −8.66 | +1.17 | −6.52 | +1.23 | +0.63 | +2.95 |
| 11 | MBIZ-11 | 3.63 | −17.50 | −2.20 | −8.67 | +0.94 | −6.34 | +1.87 | +1.40 | +3.05 |
| 12 | MMIZ-1 | 3.58 | −17.23 | −1.55 | −9.39 | +1.76 | −6.31 | +3.87 | +1.78 | +6.47 |
| 13 | MMIZ-2 | 3.77 | −17.12 | −1.51 | −9.24 | +1.13 | −6.74 | +5.44 | +2.59 | +7.98 |
| 14 | MMIZ-4 | 3.67 | −17.43 | −2.82 | −10.68 | +0.08 | −7.39 | +5.79 | +2.53 | +6.85 |
| 15 | MMIZ-5 | 3.58 | −16.96 | −1.93 | −10.37 | +0.65 | −7.59 | +5.46 | +2.72 | +6.66 |
| 16 | MMIZ-6 | 3.22 | −16.94 | +1.80 | −9.39 | +5.02 | −5.22 | +4.48 | +2.75 | +3.61 |

The substantially light-insensitive thermographic recording materials of INVENTION EXAMPLES 1 to 16 in which the thermosensitive elements contain a compound according to formula (I) exhibit substantially improved stability of the b* CIELAB values of the image background to light exposure compared with the substantially light-insensitive thermographic recording material of COMPARATIVE EXAMPLE 1 which is identical to the substantially light-insensitive thermographic recording materials of INVENTION EXAMPLES 1 to 16 except for the absence of a compound according to formula (I) in the thermosensitive element and also compared with the substantially light-insensitive thermographic recording materials of COMPARATIVE EXAMPLES 2 to 4, in which the compounds A01, A02 and A03 are present instead of a stabilizer according to formula (I). These comparative examples show that the stabilizing effect of the stabilizer according to formula (I) is dependent upon the >NH group of the 2-imazolyl group or 2-imazolyl group annelated with an aromatic ring system not being substituted, at least one (M-) group being a 2-imazolyl group annelated with an aromatic ring system and does not tolerate substitution of the >NH group in the 2-imidazolyl group by a —S— group.

INVENTION EXAMPLES 17 TO 22

The substantially light-insensitive thermographic recording materials of INVENTION EXAMPLE 19 was prepared as described for INVENTION EXAMPLE 3 and INVENTION EXAMPLES 17 and 18 as for INVENTION EXAMPLE 3 except that concentrations of MBIZ-3 of 5 and 8 mol % were used instead of 10 mol % with respect to silver behenate. The substantially light-insensitive thermographic recording materials of INVENTION EXAMPLE 22 was prepared as described for INVENTION EXAMPLE 4 and INVENTION EXAMPLES 20 and 21 as for INVENTION EXAMPLE 4 except that concentrations of MBIZ-4 of 5 and 8 mol % were used instead of 10 mol % with respect to silver behenate.

The compositions of the thermosensitive elements of the substantially light-insensitive thermographic recording materials of INVENTION EXAMPLES 17 to 22 together with those for INVENTION EXAMPLES 3 and 4 and COMPARATIVE EXAMPLE 1 in which no additional stabilizer is present in the thermosensitive element are summarized in Table 3 below.

TABLE 3

| | stabilizer | | | | R01 | R02 | T02 | S01 | S02 | | |
|---|---|---|---|---|---|---|---|---|---|---|---|
| | type | conc. mol % vs AgB | AgBeh coverage [g/m$^2$] | BL5HP [g/m$^2$] | mol % vs AgB | mol % vs AgB | mol % vs AgB | mol % vs AgB | mol % vs AgB | VL [g/m$^2$] | Oil [g/m$^2$] |
| Comparative example nr. | | | | | | | | | | | |
| 1 | — | — | 4.15 | 16.6 | 35 | 45 | 15 | 26 | 4.91 | 0.17 | 0.035 |

TABLE 3-continued

| | stabilizer | | | | R01 | R02 | T02 | S01 | S02 | | |
|---|---|---|---|---|---|---|---|---|---|---|---|
| | type | conc. mol % vs AgB | AgBeh coverage [g/m²] | BL5HP [g/m²] | mol % vs AgB | mol % vs AgB | mol % vs AgB | mol % vs AgB | mol % vs AgB | VL [g/m²] | Oil [g/m²] |
| Invention example nr. | | | | | | | | | | | |
| 17 | MBIZ-3 | 5 | 4.15 | 16.6 | 35 | 45 | 15 | 26 | 4.91 | 0.17 | 0.035 |
| 18 | MBIZ-3 | 8 | 4.15 | 16.6 | 35 | 45 | 15 | 26 | 4.91 | 0.17 | 0.035 |
| 19 | MBIZ-3 | 10 | 4.15 | 16.6 | 35 | 45 | 15 | 26 | 4.91 | 0.17 | 0.035 |
| 3 | MBIZ-3 | 10 | 4.15 | 16.6 | 35 | 45 | 15 | 26 | 4.91 | 0.17 | 0.035 |
| 20 | MBIZ-4 | 5 | 4.15 | 16.6 | 35 | 45 | 15 | 26 | 4.91 | 0.17 | 0.035 |
| 21 | MBIZ-4 | 8 | 4.15 | 16.6 | 35 | 45 | 15 | 26 | 4.91 | 0.17 | 0.035 |
| 22 | MBIZ-4 | 10 | 4.15 | 16.6 | 35 | 45 | 15 | 26 | 4.91 | 0.17 | 0.035 |
| 4 | MBIZ-4 | 10 | 4.15 | 16.6 | 35 | 45 | 15 | 26 | 4.91 | 0.17 | 0.035 |

Thermographic evaluation of the substantially light-insensitive thermographic recording materials of INVENTION EXAMPLES 17 to 22 was carried out as described for the substantially light-insensitive thermographic recording materials of INVENTION EXAMPLES 1 to 16 and COMPARATIVE EXAMPLE 1.

The Dmax values, a* and b* CIELAB-values at densities of 1.0 and 2.0 together with the results of light box experiments are given in Table 4 below together with the results for the substantially light-insensitive thermographic recording materials of INVENTION EXAMPLES 3 and 4 and COMPARATIVE EXAMPLE 1.

TABLE 4

| | stabilizer | | | CIELAB-values of prints with fresh film | | | | Δb* CIELAB-value of prints after 3 d/30° C./85% RH light-box expos. | |
|---|---|---|---|---|---|---|---|---|---|
| | | con. vs AgBeH | | D = 1.0 | | D = 2.0 | | | |
| | type | [mol %] | Dmax | a* | b* | a* | b* | D = 1.0 | Dmin |
| Comparative Example nr. | | | | | | | | | |
| 1 | — | 0 | 4.21 | −2.92 | −6.38 | −0.56 | −3.64 | +13.20 | +13.67 |
| Invention Example nr | | | | | | | | | |
| 17 | MBIZ-3 | 5 | 3.82 | −2.95 | −8.56 | −0.03 | −6.71 | +2.35 | +3.90 |
| 18 | MBIZ-3 | 8 | 3.77 | −2.83 | −8.37 | −0.15 | −6.75 | +1.64 | +3.99 |
| 19 | MBIZ-3 | 10 | 3.56 | −2.82 | −8.43 | +0.12 | −6.59 | +1.78 | +2.81 |
| 3 | MBIZ-3 | 10 | 3.79 | −2.66 | −8.06 | −0.08 | −6.80 | +0.95 | +3.67 |
| 20 | MBIZ-4 | 5 | 3.76 | −2.99 | −8.83 | −0.06 | −6.74 | +2.32 | +4.19 |
| 21 | MBIZ-4 | 8 | 3.57 | −2.82 | −8.66 | +0.05 | −6.49 | +2.33 | +4.69 |
| 22 | MBIZ-4 | 10 | 3.44 | −2.80 | −7.90 | −0.29 | −6.38 | +2.17 | +4.58 |
| 4 | MBIZ-4 | 10 | 3.49 | −1.90 | −8.99 | +1.21 | −7.16 | +2.90 | +4.02 |

No significant difference was established for MBIZ-3 and MBIZ-4 in the concentration range of 5 to 10 mol % with respect to silver behenate in respect of the effect on the image tone of fresh images and their light-box stabilizing effect.

COMPARATIVE EXAMPLES 5 TO 8 AND INVENTION EXAMPLES 23 TO 34

The substantially light-insensitive thermographic recording materials of COMPARATIVE EXAMPLES 5 to 8 and INVENTION EXAMPLES 23 to 34 were prepared by coating a dispersion with the following ingredients in 2-butanone onto a 175 μm thick blue-pigmented polyethylene terephthalate support with CIELAB a*- and b*-values of −9.5 and −17.9 respectively subbed on the emulsion-coated side with subbing layer 01 giving layers after drying at 50° C. for 1 h in a drying cupboard with the compositions given in Table 5 below.

The thermosensitive elements were then coated with a protective layer as described for substantially light-insensitive thermographic recording materials of COMPARATIVE EXAMPLES 1 to 4 and INVENTION EXAMPLES 1 to 16.

TABLE 5

| | stabilizer | | | | R01 | R02 | T01 | T02 | S01 | S02 | | | |
|---|---|---|---|---|---|---|---|---|---|---|---|---|---|
| | type | conc. mol % vs AgB | AgBeh coverage [g/m²] | POLY 01 [g/m²] | mol % vs AgB | mol % vs AgB | mol % vs AgB | mol % vs AgB | mol % vs AgB | mol % vs AgB | S03 mol % vs AgB | VL [g/m²] | Oil [g/m²] |
| Comparative example nr. | | | | | | | | | | | | | |
| 5 | — | — | 3.48 | 12.52 | 50 | 45 | 3 | 15 | 26 | 6.0 | 5.0 | 0.184 | 0.037 |
| 6 | A01 | 5 | 3.40 | 12.23 | 50 | 45 | 3 | 15 | 26 | 6.0 | 5.0 | 0.180 | 0.036 |
| 7 | A02 | 5 | 3.42 | 12.33 | 50 | 45 | 3 | 15 | 26 | 6.0 | 5.0 | 0.182 | 0.036 |
| 8 | A03 | 5 | 3.37 | 12.14 | 50 | 45 | 3 | 15 | 26 | 6.0 | 5.0 | 0.179 | 0.036 |
| Invention example nr | | | | | | | | | | | | | |
| 23 | MBIZ-1 | 5 | 3.35 | 12.04 | 50 | 45 | 3 | 15 | 26 | 6.0 | 5.0 | 0.177 | 0.035 |
| 24 | MBIZ-2 | 5 | 3.37 | 12.14 | 50 | 45 | 3 | 15 | 26 | 6.0 | 5.0 | 0.179 | 0.036 |
| 25 | MBIZ-3 | 5 | 3.37 | 12.14 | 50 | 45 | 3 | 15 | 26 | 6.0 | 5.0 | 0.179 | 0.036 |
| 26 | MBIZ-4 | 5 | 3.40 | 12.23 | 50 | 45 | 3 | 15 | 26 | 6.0 | 5.0 | 0.180 | 0.036 |
| 27 | MBIZ-5 | 5 | 3.45 | 12.42 | 50 | 45 | 3 | 15 | 26 | 6.0 | 5.0 | 0.183 | 0.037 |
| 28 | MBIZ-6 | 5 | 3.50 | 12.61 | 50 | 45 | 3 | 15 | 26 | 6.0 | 5.0 | 0.186 | 0.035 |
| 29 | MBIZ-7 | 5 | 3.42 | 12.33 | 50 | 45 | 3 | 15 | 26 | 6.0 | 5.0 | 0.182 | 0.036 |
| 30 | MBIZ-8 | 5 | 3.40 | 12.23 | 50 | 45 | 3 | 15 | 26 | 6.0 | 5.0 | 0.180 | 0.036 |
| 31 | MBIZ-9 | 5 | 3.40 | 12.23 | 50 | 45 | 3 | 15 | 26 | 6.0 | 5.0 | 0.180 | 0.036 |
| 32 | MBIZ-10 | 5 | 3.45 | 12.42 | 50 | 45 | 3 | 15 | 26 | 6.0 | 5.0 | 0.183 | 0.037 |
| 33 | MBIZ-11 | 5 | 3.37 | 12.14 | 50 | 45 | 3 | 15 | 26 | 6.0 | 5.0 | 0.179 | 0.036 |
| 34 | MMIZ-4 | 5 | 3.35 | 12.04 | 50 | 45 | 3 | 15 | 26 | 6.0 | 5.0 | 0.177 | 0.035 |

Thermographic evaluation of the substantially light-insensitive thermographic recording materials of COMPARATIVE EXAMPLES 5 to 8 and INVENTION EXAMPLES 23 to 34 was carried out as described for the substantially light-insensitive thermographic recording materials of INVENTION EXAMPLES 1 to 16 and COMPARATIVE EXAMPLES 1 to 4.

The Dmax values, a* and b* CIELAB-values at densities of 1.0 and 2.0 together with the results of light box experiments are given in Table 6 below. Also included in Table 6 are the results of shelf-life experiments in which the difference in the CIELAB b*-values at D=1.0 for prints produced with fresh materials and prints produced with materials which were subjected for 4 days to a temperature of 45° C. and a relative humidity of 70%.

TABLE 6

| | | | | | | | | | Δb* CIELAB-value of | |
|---|---|---|---|---|---|---|---|---|---|---|
| | | | CIELAB-value of prints with fresh film | | | | prints after 3 d/30° C./85% RH light-box | | fresh print due to storage at 4 d/45° C./70% RH |
| | stabilizer | | D = 1.0 | | D = 2.0 | | | | |
| | type | Dmax | a* | b* | a* | b* | D = 1.0 | Dmin | D = 1.0 |
| Comparative Example nr. | | | | | | | | | |
| 5 | — | 3.63 | −1.27 | −7.60 | +2.12 | −5.97 | +2.42 | +3.66 | +1.43 |
| 6 | A01 | 3.87 | −1.02 | −2.88 | +1.56 | −0.74 | +1.89 | +4.06 | +2.96 |
| 7 | A02 | 3.83 | −1.09 | −4.95 | +0.79 | −4.65 | +1.36 | +4.75 | −0.14 |
| 8 | A03 | 3.37 | −0.77 | −6.24 | +3.29 | −5.17 | +3.17 | +6.69 | −0.64 |
| Invention Example nr | | | | | | | | | |
| 23 | MBIZ-1 | 3.44 | −1.83 | −6.46 | +1.53 | −5.86 | +3.08 | +4.08 | +0.62 |
| 24 | MBIZ-2 | 3.45 | −1.98 | −6.00 | +1.97 | −4.91 | +1.89 | +4.23 | −0.30 |
| 25 | MBIZ-3 | 3.32 | −2.00 | −6.42 | +1.56 | −5.69 | +1.86 | +3.51 | +0.36 |
| 26 | MBIZ-4 | 3.32 | −1.17 | −6.73 | +2.99 | −5.56 | +2.13 | +3.57 | +0.21 |
| 27 | MBIZ-5 | 3.32 | −1.93 | −5.94 | +1.07 | −5.33 | +2.44 | +4.81 | +0.09 |
| 28 | MBIZ-6 | 3.33 | −1.65 | −6.35 | +1.89 | −5.51 | +1.85 | +4.10 | +0.36 |
| 29 | MBIZ-7 | 3.40 | −1.22 | −7.25 | +2.13 | −6.01 | +0.75 | +2.53 | +0.25 |
| 30 | MBIZ-8 | 3.31 | −1.24 | −5.18 | +2.79 | −3.67 | +4.54 | +2.99 | +0.15 |
| 31 | MBIZ-9 | 3.29 | −1.29 | −6.76 | +2.57 | −5.26 | +3.82 | +3.64 | +0.30 |
| 32 | MBIZ-10 | 3.40 | −0.95 | −6.95 | +2.56 | −5.51 | +2.15 | +3.72 | +0.36 |
| 33 | MBIZ-11 | 3.37 | −0.67 | −7.25 | +2.17 | −3.49 | +3.39 | +3.57 | +0.40 |
| 34 | MMIZ-4 | 3.62 | −1.26 | −6.21 | +3.07 | −4.91 | +3.82 | +5.34 | −0.42 |

The thermosensitive elements of the substantially light-insensitive thermographic materials of COMPARATIVE EXAMPLES 5 to 8 and INVENTION EXAMPLES 23 to 34 are significantly different from those of the substantially light-insensitive thermographic materials of COMPARATIVE EXAMPLES 1 to 4 and INVENTION EXAMPLES 1 to 22 in two important respects: they contain benzotriazole (S03) as a further stabilizer and they contain as binder POLY 01, a copolymer of vinyl aceto-acetal, vinyl butyral, vinyl alcohol and vinyl acetate instead of BL5HP, a polyvinyl butyral. Benzotriazole is widely used as a stabilizer in substantially light-insensitive thermographic materials and has excellent stabilizing properties except in respect of self-life stability with a strong increase in the b* CIELAB value at density of 1.0.

The substantially light-insensitive thermographic materials of INVENTION EXAMPLES 23 to 34 all exhibit substantially higher shelf-life stability i.e. a lower increase in b* CIELAB value at a density of 1.0, than the substantially light-insensitive thermographic material of COMPARATIVE EXAMPLE 5 in which no further stabilizer is present. Therefore, stabilizers according to formula (I) are surprisingly capable of at least ameliorating the poor shelf-life stability of thermographic materials with benzotriazole.

Furthermore, the substantially light-insensitive thermographic recording materials of INVENTION EXAMPLES 23 to 34 in which the thermosensitive elements contained a compound according to formula (I) and the binder used was POLY 01 exhibited a better image tone and image tone stability profile than the substantially light-insensitive thermographic materials of COMPARATIVE EXAMPLES 6 to 8 in which the thermosensitive elements contain one of compounds A01, A02 or A03 in the same molar concentration in respect to silver behenate: higher b* values in prints with fresh film and very poor shelf-life stability in the presence of A01; higher b* values in prints with fresh film and a strong increase in the b* value for Dmin in light box experiments in the presence of A02; and higher a* values in prints with fresh film and a very strong increase in the b* value for Dmin in light box experiments in the presence of A03.

COMPARATIVE EXAMPLES 9 AND 10 AND INVENTION EXAMPLES 35 TO 42

The substantially light-insensitive thermographic materials of COMPARATIVE EXAMPLES 9 and 10 and INVENTION EXAMPLES 35 to 42 was prepared as described for COMPARATIVE EXAMPLES 5 to 8 and INVENTION EXAMPLES 23 to 34 except as indicated in the thermosensitive element compositions given in Table 7 below.

TABLE 7

| | stabilizer | | | | R01 | R02 | T01 | T02 | S01 | S02 | | | |
|---|---|---|---|---|---|---|---|---|---|---|---|---|---|
| | type | conc. mol % vs AgB | AgBeh coverage [g/m$^2$] | POLY 01 [g/m$^2$] | mol % vs AgB | mol % vs AgB | mol % vs AgB | mol % vs AgB | mol % vs AgB | mol % vs AgB | S03 mol % vs AgB | VL [g/m$^2$] | Oil [g/m$^2$] |
| Comparative example nr. | | | | | | | | | | | | | |
| 9 | — | — | 3.30 | 11.88 | 50 | 45 | 3 | 15 | 26 | 6.0 | 5.0 | 0.175 | 0.035 |
| 10 | — | — | 3.37 | 12.14 | 50 | 45 | 3 | 15 | 26 | 6.0 | — | 0.179 | 0.036 |
| Invention example nr | | | | | | | | | | | | | |
| 35 | MBIZ-3 | 5 | 3.35 | 12.04 | 50 | 45 | 3 | 15 | 26 | 6.0 | — | 0.177 | 0.035 |
| 36 | MBIZ-3 | 4 | 3.35 | 12.04 | 50 | 45 | 3 | 15 | 26 | 6.0 | 5.0 | 0.177 | 0.035 |
| 37 | MBIZ-3 | 2 | 3.37 | 12.14 | 50 | 45 | 3 | 15 | 26 | 6.0 | 5.0 | 0.179 | 0.036 |
| 38 | MBIZ-7 | 2 | 3.35 | 12.04 | 50 | 45 | 3 | 15 | 26 | 6.0 | 5.0 | 0.177 | 0.035 |
| 39 | MBIZ-10 | 5 | 3.30 | 11.88 | 50 | 45 | 3 | 15 | 26 | 6.0 | — | 0.175 | 0.035 |
| 40 | MBIZ-10 | 2 | 3.27 | 11.76 | 50 | 45 | 3 | 15 | 26 | 6.0 | 5.0 | 0.173 | 0.035 |
| 41 | MBIZ-11 | 5 | 3.24 | 11.66 | 50 | 45 | 3 | 15 | 26 | 6.0 | — | 0.172 | 0.034 |
| 42 | MBIZ-11 | 2 | 3.32 | 11.95 | 50 | 45 | 3 | 15 | 26 | 6.0 | 5.0 | 0.176 | 0.035 |
| 43 | MBIZ-13 | 5 | 3.50 | 12.61 | 50 | 45 | 3 | 15 | 26 | 6.0 | — | 0.186 | 0.037 |
| 44 | MBIZ-13 | 4 | 3.37 | 12.14 | 50 | 45 | 3 | 15 | 26 | 6.0 | 5.0 | 0.179 | 0.036 |
| 45 | MEIZ-13 | 2 | 3.42 | 12.33 | 50 | 45 | 3 | 15 | 26 | 6.0 | 5.0 | 0.182 | 0.037 |

Thermographic evaluation of the substantially light-insensitive thermographic recording materials of COMPARATIVE EXAMPLES 9 and 10 and INVENTION EXAMPLES 35 to 42 was carried out as described for the substantially light-insensitive thermographic recording materials of COMPARATIVE EXAMPLES 5 to 8 and INVENTION EXAMPLES 23 to 34.

The Dmax values, a* and b* CIELAB-values at densities of 1.0 and 2.0 together with the results of light box experiments and shelf-life experiments are given together with the results for COMPARATIVE EXAMPLE 5 and INVENTION EXAMPLES 25, 29, 32 and 33 in Table 8 below.

TABLE 8

| | stabilizer | | | CIELAB-values of prints with fresh film | | | | Δb* CIELAB-value of prints after 3 d/30° C./85% RH light-box | | Δb* CIELAB-value of fresh print after 4 d/45° C./70% RH storage |
|---|---|---|---|---|---|---|---|---|---|---|
| | | | | D = 1.0 | | D = 2.0 | | | | |
| | type | | Dmax | a* | b* | a* | b* | D = 1.0 | Dmin | D = 1.0 |
| Comparative Example nr. | | | | | | | | | | |
| 9 | — | S03 | 3.61 | −1.46 | −7.73 | +2.61 | −5.13 | +2.96 | +3.49 | +1.13 |
| 10 | — | — | 3.71 | −1.79 | −5.59 | +2.46 | −3.22 | +8.66 | +6.29 | +0.61 |
| Invention Example nr | | | | | | | | | | |
| 35 | MBIZ-3 | — | 3.44 | −1.83 | −6.66 | +2.25 | −4.97 | +3.60 | +4.52 | +0.48 |
| 25 | MBIZ-3 | S03 | 3.32 | −2.00 | −6.42 | +1.56 | −5.69 | +1.86 | +3.51 | +0.36 |
| 36 | MBIZ-3 | S03 | 3.33 | −1.84 | −7.94 | +1.68 | −6.13 | +1.16 | +2.13 | +0.86 |
| 37 | MBIZ-3 | S03 | 3.38 | −1.21 | −7.24 | +2.57 | −5.42 | +1.65 | +3.25 | +0.35 |
| COMP 9 | — | S03 | 3.61 | −1.46 | −7.73 | +2.61 | −5.13 | +2.96 | +3.49 | +1.13 |
| COMP 5 | — | S03 | 3.63 | −1.27 | −7.60 | +2.12 | −5.97 | +2.42 | +3.66 | +1.43 |
| 29 | MBIZ-7 | S03 | 3.40 | −1.22 | −7.25 | +2.13 | −6.01 | +0.75 | +2.53 | +0.25 |
| 38 | MBIZ-7 | S03 | 3.46 | −1.49 | −8.50 | +1.91 | −6.12 | +1.48 | +2.52 | +0.98 |
| COMP 9 | — | S03 | 3.61 | −1.46 | −7.73 | +2.61 | −5.13 | +2.96 | +3.49 | +1.13 |
| COMP 5 | — | S03 | 3.63 | −1.27 | −7.60 | +2.12 | −5.97 | +2.42 | +3.66 | +1.43 |
| 39 | MBIZ-10 | — | 3.40 | −1.32 | −7.76 | +2.69 | −5.54 | +2.70 | +3.95 | +1.32 |
| 32 | MBIZ-10 | S03 | 3.40 | −0.95 | −6.95 | +2.56 | −5.51 | +2.15 | +3.72 | +0.36 |
| 40 | MBIZ-10 | 803 | 3.34 | −1.55 | −8.34 | +2.09 | −6.11 | +2.25 | +2.82 | +0.80 |
| COMP 9 | — | S03 | 3.61 | −1.46 | −7.73 | +2.61 | −5.13 | +2.96 | +3.49 | +1.13 |
| COMP 5 | — | S03 | 3.63 | −1.27 | −7.60 | +2.12 | −5.97 | +2.42 | +3.66 | +1.43 |
| 41 | MBIZ-11 | — | 3.32 | −1.47 | −8.03 | +2.83 | −5.54 | +5.52 | +3.78 | +1.10 |
| 33 | MBIZ-11 | S03 | 3.37 | −0.67 | −7.25 | +2.17 | −3.49 | +3.39 | +3.57 | +0.40 |
| 42 | MBIZ-11 | S03 | 3.40 | −1.63 | −7.90 | +2.32 | −5.23 | +2.07 | +2.81 | +0.89 |
| COMP 9 | — | S03 | 3.61 | −1.46 | −7.73 | +2.61 | −5.13 | +2.96 | +3.49 | +1.13 |
| COMP 5 | — | S03 | 3.63 | −1.27 | −7.60 | +2.12 | −5.97 | +2.42 | +3.66 | +1.43 |
| 43 | MBIZ-13 | — | 3.30 | −1.60 | −8.90 | +2.10 | −6.55 | +1.87 | +2.55 | +0.39 |
| 44 | MBIZ-13 | S03 | 3.13 | −1.29 | −9.19 | +1.80 | −6.68 | +1.20 | +2.39 | +0.26 |
| 45 | MBIZ-13 | S03 | 3.19 | −1.16 | −8.99 | +1.97 | −6.84 | +1.23 | +2.59 | +0.21 |
| COMP 9 | — | S03 | 3.61 | −1.46 | −7.73 | +2.61 | −5.13 | +2.96 | +3.49 | +1.13 |
| COMP 5 | — | S03 | 3.63 | −1.27 | −7.60 | +2.12 | −5.97 | +2.42 | +3.66 | +1.43 |

The results in Table 8 cast further light upon the surprising ameliorating effect of the stabilizers according to formula (I) upon the effect of benzotriazole stabilization on the shelf-life stability of substantially light-insensitive thermographic recording materials. The results for COMPARATIVE EXAMPLE 10 show that the base composition without benzotriazole and stabilizers according to formula (I) exhibits a fairly good shelf-life stability as can be seen from the Δb* CIELAB value at a density of 1.0 of +0.61. The presence of 5 mol % benzotriazole in respect of silver behenate clearly worsens the shelf-life stability as can be seen from the increase in Δb* CIELAB value at a density of 1.0 from +0.61 to +1.13 or +1.43.

The presence of 5 mol % MBIZ-3 or MBIZ-13 with respect to silver behenate slightly improves the shelf-life stability as can be seen from the slight decrease in Δb* CIELAB value at a density of 1.0 from +0.61 to +0.48 and +0.39 respectively, but the presence of 5 mol % MBIZ-10 or MBIZ-11 with respect to silver behenate worsens the shelf-life stability as can be seen from the increase in Δb* CIELAB at a density of 1.0 from +0.61 to +1.32 and +1.10 respectively.

However, the results in Table 8 show that when benzotriazole and the stabilizers according to formula (I) are simultaneously incorporated into the base composition a synergetic improvement in shelf-life stability occurred in the case of MBIZ-3, MBIZ-7, MBIZ-10, MBIZ-11 and MBIZ-13 i.e. the shelf-life stability obtained is better than that obtained with either benzotriazole or any one of MBIZ-3, MBIZ-7, MBIZ-10, MBIZ-11 and MBIZ-13 separately. This is so consistent that the results with INVENTION EXAMPLE 36 can be disregarded as being anomalous. The optimum mix of benzotriazole and the stabilizer according to formula (I) appears to depend upon the choice of stabilizer according to formula (I), being 5 mol % benzotriazole/2 mol % MBIZ-3 in the case of MBIZ-3, being 5 mol % benzotriazole/5 mol % stabilizer according to formula (I) in the case of MBIZ-7, MBIZ-10 and MBIZ-11 and being 5 mol % benzotriazole/2–4 mol % MBIZ-13 in the case of MBIZ-13.

The present invention may include any feature or combination of features disclosed herein either implicitly or explicitly or any generalisation thereof irrespective of whether it relates to the presently claimed invention. In view of the foregoing description it will be evident to a person skilled in the art that various modifications may be made within the scope of the invention.

Having described in detail preferred embodiments of the current invention, it will now be apparent to those skilled in the art that numerous modifications can be made therein without departing from the scope of the invention as defined in the following claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A substantially light-insensitive black and white monosheet thermographic recording material comprising a support and a thermosensitive element, said thermosensitive element comprising a substantially light-insensitive organic silver salt, an organic reducing agent therefor in thermal working relationship therewith, at least one binder and at least one stabilizer represented by formula (I):

(I)

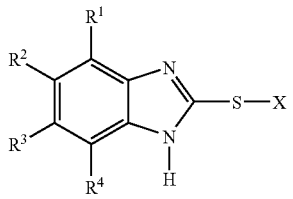

wherein $R^1$, $R^2$, $R^3$ and $R^4$ are independently selected from the group consisting of a hydrogen atom, halogen atoms and aliphatic, alkoxy, nitro, acyl, sulfonyl, nitrile, alkaryl, aryl, amino, thioalkyl, aldehyde, urea, —O—(C═O)-alkyl, —O—(C═O)-aryl, —O—(C═O)—O—alkyl, —O—(C═O)—O-aryl, —NH—(C═O)-alkyl, —NH—(C═O)-aryl, —(C═O)—NH-alkyl, —(C═O)—NH—aryl, —NH—($SO_2$)-alkyl, —NH—($SO_2$)-aryl, —($SO_2$)—NH-alkyl, —($SO_2$)—NH-aryl groups: X is —A—M: A is selected from the group consisting of substituted aliphatic groups, unsubstituted aliphatic groups, substituted cycloaliphatic groups, unsubstituted cycloaliphatic groups, substituted aromatic groups and unsubstituted aromatic groups where in each of said groups one or more of the chain or ring carbon atoms may be substituted by one or more atoms selected from the group consisting of S, O, Si, N and P atoms: and -M is a substituted or unsubstituted group selected from the group consisting of a -(2-S-imidazole) group and a -(2-S-imidazole) group annelated with an aromatic ring system, the optional substituents for -M being selected from the group consisting of halogen atoms and aliphatic, alkoxy, nitro, acyl, sulfonyl, nitrite, alkaryl and aryl groups.

2. A substantially light-insensitive black and white monosheet thermographic recording material comprising a support and a thermosensitive element, said thermosensitive element comprising a substantially light-insensitive organic silver salt, an organic reducing agent therefor in thermal working relationship therewith, at least one binder and at least one stabilizer represented by formula (I):

(I)

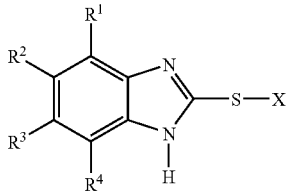

wherein $R^1$, $R^2$, $R^3$ and $R^4$ are independently selected from the group consisting of a hydrogen atom, halogen atoms and aliphatic, alkoxy, nitro, acyl, sulfonyl, nitrile, alkaryl, aryl, amino, thioalkyl, aldehyde, urea, —O—(C═O)-alkyl, —O—(C═O)-aryl, —O—(C═O)—O-alkyl, —O—(C═O)—O—aryl, —NH—(C═O)-alkyl, —NH—(C═O)-aryl, —(C═O)—NH—alkyl, —(C═O)—NH—aryl, —NH—($SO_2$)-alkyl, —NH—($SO_2$)-aryl, —($SO_2$)-NH-alkyl, —($SO_2$)-NH-aryl groups: X is -A-$(CH_2)_m$-M m is 2 to 20: A is selected from the group consisting of substituted aliphatic groups, unsubstituted aliphatic groups, substituted cycloaliphatic groups, unsubstituted cycloaliphatic groups, substituted aromatic groups and unsubstituted aromatic groups where in each of said groups one or more of the chain or ring carbon atoms may be substituted by one or more atoms selected from the group consisting of S, O, Si, N and P atoms; and -M is a substituted or unsubstituted group selected from the group consisting of a -(2-S-imidazole) group and a -(2-S-imidazole) group annelated with an aromatic ring system, the optional substituents for -M being selected from the group consisting of halogen atoms and aliphatic, alkoxy, nitro, acyl, sulfonyl, nitrile, alkaryl and aryl groups.

3. A substantially light-insensitive black and white Monosheet thermographic recording material comprising a support and a thermosensitive element, said thermosensitive element comprising a substantially light-insensitive organic silver salt, an organic reducing agent therefor in thermal working relationship therewith, at least one binder and at least one stabilizer represented by formula (I):

(I)

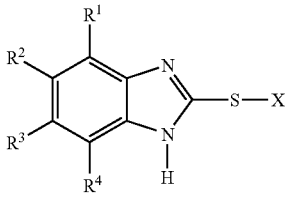

wherein $R^1$, $R^2$, $R^3$ and $R^4$ are independently selected from the group consisting of a hydrogen atom, halogen atoms and aliphatic, alkoxy, nitro, acyl, sulfonyl, nitrile, alkaryl, aryl, amino, thioalkyl, aldehyde, urea, —O—(C═O)-alkyl, —O—(C═O)-aryl, —O—(C═O)—O—alkyl, —O—(C═O)—O-aryl, —NH—(C═O)-alkyl, —NH—(C═O)-aryl, —(C═O)—NH-alkyl, —(C═O)—NH—aryl, —NH—($SO_2$)-alkyl, —NH-($SO_2$)-aryl, —($SO_2$)-NH-alkyl, —($SO_2$)-NH-aryl groups; X is -A-$(CH_2)_m$-M; m is 4 to 9; A is selected from the group consisting of substituted aliphatic groups, unsubstituted aliphatic groups, substituted cycloaliphatic groups, unsubstituted cycloaliphatic groups, substituted aromatic groups and unsubstituted aromatic groups where in each of said groups one or more of the chain or ring carbon atoms may be substituted by one or more atoms selected from the group consisting of S, O, Si, N and P atoms; and -M is a substituted or unsubstituted group selected from the group consisting of a -(2-S-imidazole) group and a -(2-S-imidazole) group annelated with an aromatic ring system, the optional substituents for -M being selected from the group consisting of halogen atoms and aliphatic, alkoxy, nitro, acyl, sulfonyl, nitrile, alkaryl and aryl groups.

4. A substantially light-insensitive black and white monosheet thermographic recording material comprising a support and a thermosensitive element, said thermosensitive element comprising a substantially light-insensitive organic silver salt, an organic reducing agent therefor in thermal working relationship therewith, at least one binder and at least one stabilizer is selected from the group consisting of:

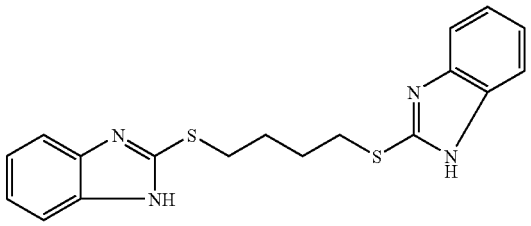

;

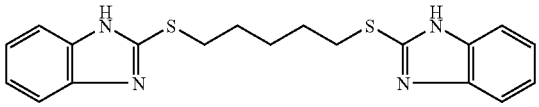

;

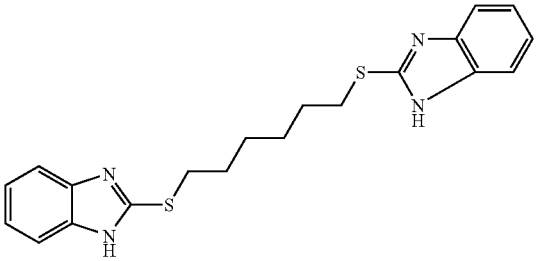

;

-continued

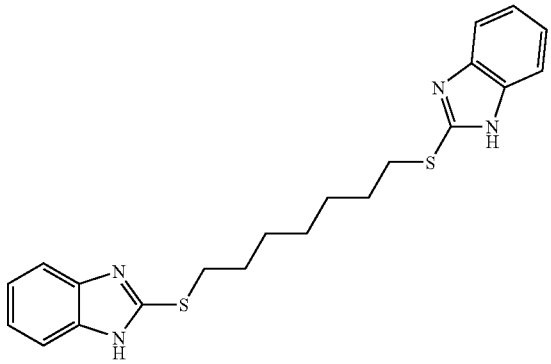

;

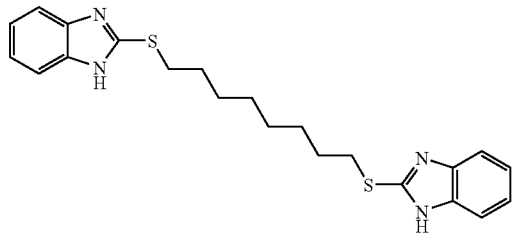

; and

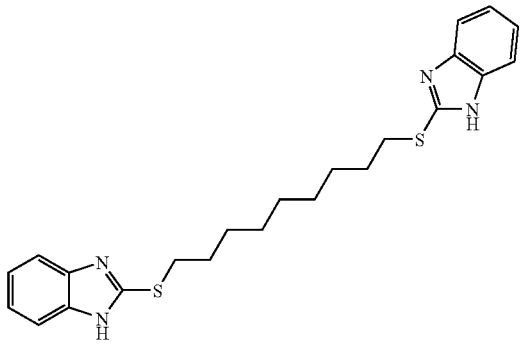

.

5. A substantially light-insensitive black and white monosheet thermographic recording material comprising a support and a thermosensitive element, said thermosensitive element comprising a substantially light-insensitive organic silver salt, an organic reducing agent therefor in thermal working relationship therewith, at least one binder and at least one stabilizer is selected from the group consisting of:

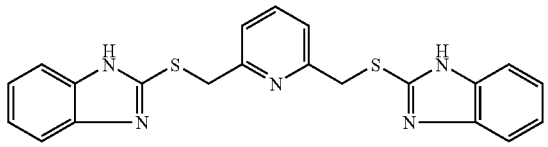

;

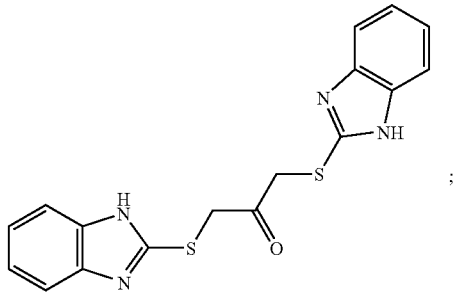

;

-continued

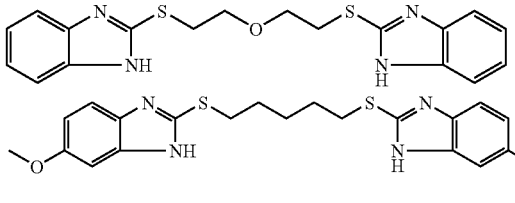

; and

6. The substantially light-insensitive black and white monosheet thermographic recording material according to claim 1, wherein said at least one binder comprises at least one first polymer consisting of vinyl aceto-acetal monomer units and monomer units selected from the group consisting of vinyl butyral, vinyl alcohol, vinyl acetate and itaconic acid monomer units, wherein the weight ratio of said at least one binder to said substantially light-insensitive organic silver salt in said thermosensitive element is greater than 1.5; and said at least one binder optionally contains less than 40% by weight of a second polymer consisting of vinyl butyral monomer units and optionally vinyl alcohol and/or vinyl acetate monomer units.

7. The substantially light-insensitive black and white monosheet thermographic recording material according to claim 1, wherein said thermosensitive element further contains an optionally substituted benzotriazole.

8. A substantially light-insensitive black and white monosheet thermographic recording material comprising a support and a thermosensitive element, said thermosensitive element containing a substantially light-insensitive organic silver salt, an organic reducing agent therefor in thermal working relationship therewith, at least one binder and at least one stabilizer represented by formula (I):

(I)

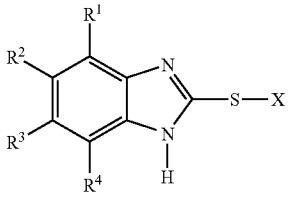

wherein $R^1$, $R^2$, $R_3$ and $R_4$ are independently selected from the group consisting of a hydrogen atom, halogen atoms and aliphatic, alkoxy, nitro, acyl, nitrile, alkaryl, aryl, amino, thioalkyl, aldehyde, urea, —O—(C═O)-alkyl, —O—(C═O)-aryl, —O—(C═O)—O-alkyl, —O—(C═O)—O—aryl, —NH—(C═O)-alkyl, —NH—(C═O)-aryl, —(C═O)—NH-alkyl, —(C═O)—NH-aryl, —NH—($SO_2$)-alkyl, —NH—($SO_2$)-aryl, —($SO_2$)-NH-alkyl, —($SO_2$)-NH-aryl groups; X is represented by -A(-M)$_m$ or is selected from the group consisting of substituted aliphatic groups, unsubstituted aliphatic groups, substituted cycloaliphatic groups, unsubstituted cycloaliphatic groups, substituted aromatic groups and unsubstituted aromatic groups where in each of said groups one or more of the chain or ring carbon atoms may be substituted by one of more atoms selected from the group consisting of S, O, Si, N and P atoms; n is 2, 3 or 4; A is selected from the group consisting of substituted aliphatic groups, unsubstituted aliphatic groups, substituted cycloaliphatic groups, unsubstituted cycloaliphatic groups, substituted aromatic groups and unsubstituted aromatic groups where in each of said groups one or more of the chain or ring carbon atoms may be substituted by one of more atoms selected from the group consisting of S, O, Si, N and P atoms; each (-M) is independently a substituted or unsubstituted group selected from the group consisting of -(2-S-imidazole) groups and -(2-S-imidazole) groups annelated with an aromatic ring system, the optional substituents for -M being selected from the group consisting of halogen atoms and aliphatic, alkoxy, nitro, acyl, sulfonyl, nitrile, alkaryl and aryl groups.

9. The substantially light-insensitive black and white monosheet thermographic recording material according to claim 8, wherein A is selected from the group consisting of an optionally substituted alkyl groups, optionally substituted alkenyl groups, optionally substituted alkynyl groups, optionally substituted alkyaryl groups, optionally substituted alkyl-heterocyclic groups, optionally substituted alkyl-heteroaromatic groups, optionally substituted alkyl groups in which at least one of the non-terminal main chain carbon atoms is substituted with an oxygen or a sulfur atom, optionally substituted aryl groups, optionally substituted alkyl-aryl-alkyl groups, optionally substituted alkyl-heteroaryl-alkyl groups, optionally substituted alkyl-COO-alkyl-OOC-alkyl groups, optionally substituted alkyl-O—COO-alkyl groups, optionally substituted alkyl-CONH-alkyl groups, and optionally substituted alkyl-COO-aryl-OOC-alkyl groups.

10. The substantially light-insensitive black and white monosheet thermographic recording material according to claim 8, wherein in said at least one stabilizer according to formula (I) X is -A-M and -M is a -(2-S-imidazole) group or a (2-S-imidazole) group annelated with an aromatic ring system.

11. The substantially light-insensitive black and white monosheet thermographic recording material according to claim 8, wherein in said at least one stabilizer according to formula (I) X is -A-($CH_2$)$_m$-M, wherein m is 2 to 20 and -M is a (2-S-imidazole) group or a -(2-S-imidazole) group annelated with an aromatic ring system.

12. The substantially light-insensitive black and white monosheet thermographic recording material according to claim 8, wherein in said at least one stabilizer according to formula (I) X is -A-($CH_2$)$_m$-M, wherein m is 4 to 9 and -M is a (2-S-imidazole) group or a (2-S-imidazole) group annelated with an aromatic ring system.

13. The substantially light-insensitive black and white monosheet thermographic recording material according to claim 8, wherein said at least one stabilizer is selected from the group consisting of:

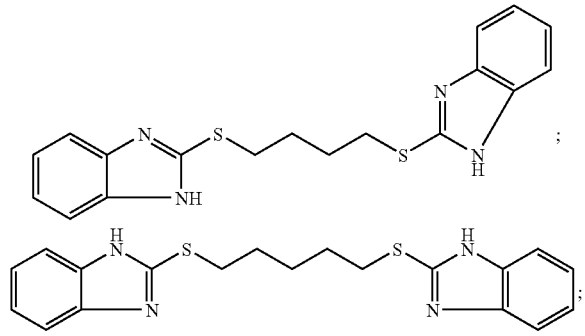

;

;

-continued

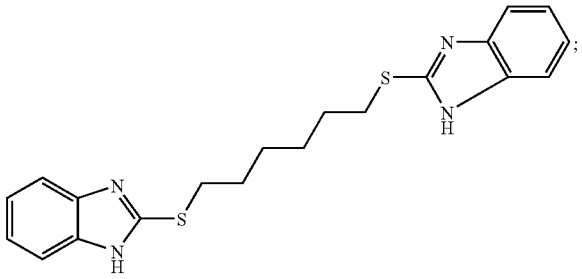

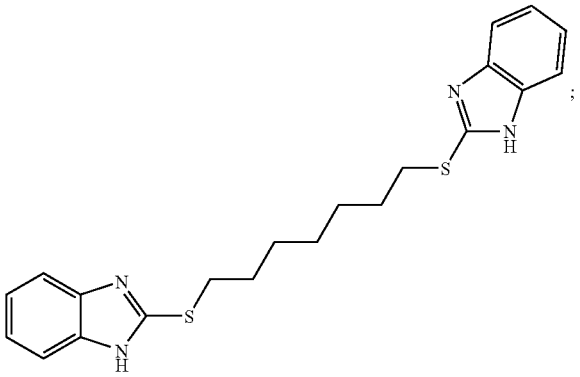

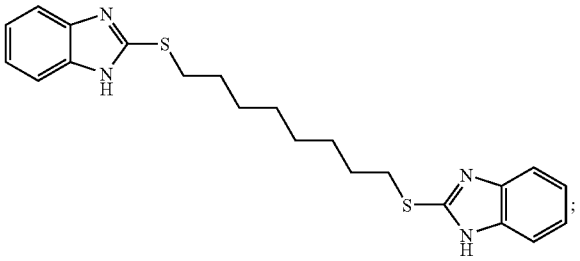

and

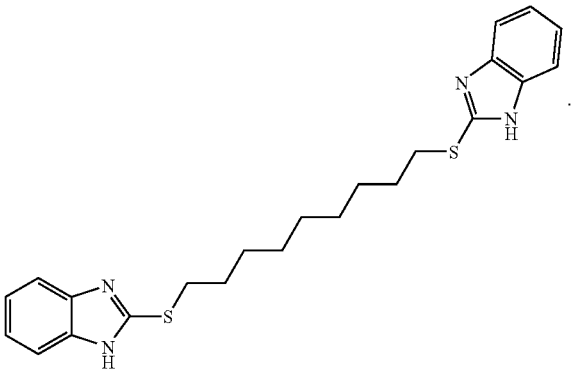

14. The substantially light-insensitive black and white monosheet thermographic recording material according to claim 8, wherein said at least one stabilizer is selected from the group consisting of:

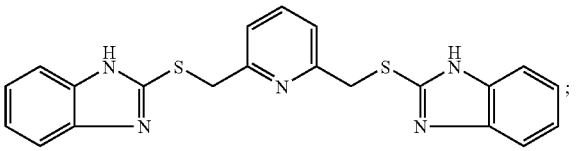

-continued

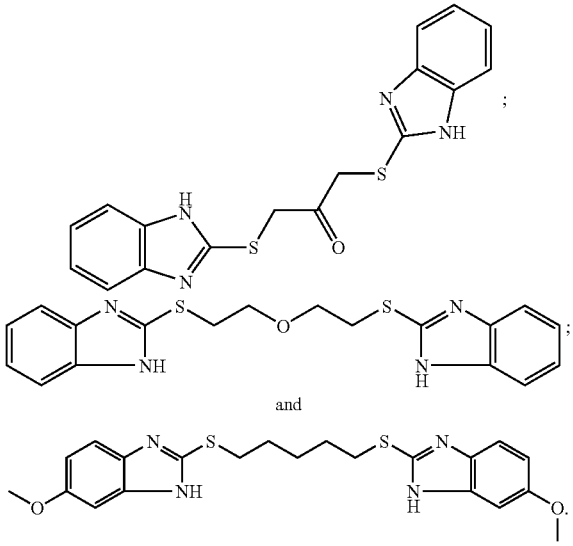

and

15. The substantially light-insensitive black and white monosheet thermographic recording material according to claim 8, wherein said at least one binder comprises at least one first polymer consisting of vinyl aceto-acetal monomer units and monomer units selected from the group consisting of vinyl butyral, vinyl alcohol, vinyl acetate and itaconic acid monomer units, wherein the weight ratio of said at least one binder to said substantially light-insensitive organic silver salt in said thermosensitive element is greater than 1.5; and said at least one binder optionally contains less than 40% by weight of a second polymer consisting of vinyl butyral monomer units and optionally vinyl alcohol and/or vinyl acetate monomer units.

16. The substantially light-insensitive black and white monosheet thermographic recording material according to claim 8, wherein said thermosensitive element further contains an optionally substituted benzotriazole.

17. The substantially light-insensitive black and white monosheet thermographic recording material according to claim 2, wherein said at least one binder comprises at least one first polymer consisting of vinyl aceto-acetal monomer units and monomer units selected from the group consisting of vinyl butyral, vinyl alcohol, vinyl acetate and itaconic acid monomer units, wherein the weight ratio of said at least one binder to said substantially light-insensitive organic silver salt in said thermosensitive element is greater than 1.5; and said at least one binder optionally contains less than 40% by weight of a second polymer consisting of vinyl butyral monomer units and optionally vinyl alcohol and/or vinyl acetate monomer units.

18. The substantially light-insensitive black and white monosheet thermographic recording material according to claim 2, wherein said thermosensitive element further contains an optionally substituted benzotriazole.

19. The substantially light-insensitive black and white monosheet thermographic recording material according to claim 3, wherein said at least one binder comprises at least one first polymer consisting of vinyl aceto-acetal monomer units and monomer units selected from the group consisting of vinyl butyral, vinyl alcohol, vinyl acetate and itaconic acid monomer units, wherein the weight ratio of said at least one binder to said substantially light-insensitive organic silver salt in said thermosensitive element is greater than 1.5;

and said at least one binder optionally contains less than 40% by weight of a second polymer consisting of vinyl butyral monomer units and optionally vinyl alcohol and/or vinyl acetate monomer units.

20. The substantially light-insensitive black and white monosheet thermographic recording material according to claim 3, wherein said thermosensitive element further contains an optionally substituted benzotriazole.

21. The substantially light-insensitive black and white monosheet thermographic recording material according to claim 4, wherein said at least one binder comprises at least one first polymer consisting of vinyl aceto-acetal monomer units and monomer units selected from the group consisting of vinyl butyral, vinyl alcohol, vinyl acetate and itaconic acid monomer units, wherein the weight ratio of said at least one binder to said substantially light-insensitive organic silver salt in said thermosensitive element is greater than 1.5; and said at least one binder optionally contains less than 40% by weight of a second polymer consisting of vinyl butyral monomer units and optionally vinyl alcohol and/or vinyl acetate monomer units.

22. The substantially light-insensitive black and white monosheet thermographic recording material according to claim 4, wherein said thermosensitive element further contains an optionally substituted benzotriazole.

23. The substantially light-insensitive black and white monosheet thermographic recording material according to claim 5, wherein said at least one binder comprises at least one first polymer consisting of vinyl aceto-acetal monomer units and monomer units selected from the group consisting of vinyl butyral, vinyl alcohol, vinyl acetate and itaconic acid monomer units, wherein the weight ratio of said at least one binder to said substantially light-insensitive organic silver salt in said thermosensitive element is greater than 1.5; and said at least one binder optionally contains less than 40% by weight of a second polymer consisting of vinyl butyral monomer units and optionally vinyl alcohol and/or vinyl acetate monomer units.

24. The substantially light-insensitive black and white monosheet thermographic recording material according to claim 5, wherein said thermosensitive element further contains an optionally substituted benzotriazole.

* * * * *